US010215428B2

(12) United States Patent
Kim et al.

(10) Patent No.: US 10,215,428 B2
(45) Date of Patent: Feb. 26, 2019

(54) WASHSTAND FURNITURE

(71) Applicant: LG ELECTRONICS INC., Seoul (KR)

(72) Inventors: Jongseok Kim, Seoul (KR); Daeyun Park, Seoul (KR); Inhyung Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/915,236

(22) Filed: Mar. 8, 2018

(65) Prior Publication Data

US 2018/0259202 A1 Sep. 13, 2018

(30) Foreign Application Priority Data

Mar. 8, 2017 (KR) ..... 10-2017-0029741

(51) Int. Cl.

| | |
|---|---|
| ***F24F 3/14*** | (2006.01) |
| ***A47B 67/02*** | (2006.01) |
| ***F24H 3/04*** | (2006.01) |
| ***A47K 1/08*** | (2006.01) |
| ***A47K 1/02*** | (2006.01) |

(52) U.S. Cl.

CPC ..... *F24F 3/14* (2013.01); *A47B 67/02* (2013.01); *A47K 1/02* (2013.01); *A47K 1/08* (2013.01); *F24H 3/0411* (2013.01)

(58) Field of Classification Search

CPC ..... A47K 1/02; A47K 2210/00; F24F 3/14; F26B 25/06; F26B 25/14; F26B 23/001; F26B 21/004; A47B 21/02; B08B 3/006

USPC ..... 34/209, 210, 211, 86

See application file for complete search history.

(56) References Cited

U.S. PATENT DOCUMENTS

| | | | | |
|---|---|---|---|---|
| 2,175,329 | A * | 10/1939 | Watt | E03C 1/044 237/19 |
| 2,287,657 | A | 6/1942 | Wisckol | |
| 5,522,411 | A * | 6/1996 | Johnson | A47K 5/1202 134/104.2 |
| 2007/0157378 | A1* | 7/2007 | Kendall | A47B 67/04 4/630 |
| 2008/0256826 | A1* | 10/2008 | Zarembinski | D06F 58/10 34/562 |

(Continued)

OTHER PUBLICATIONS

U.S. Office Action dated Oct. 5, 2018 issued in related co-pending U.S. Appl. No. 15/915,216.

*Primary Examiner* — Janie Loeppke

(74) *Attorney, Agent, or Firm* — KED & Associated, LLP

(57) ABSTRACT

A washstand furniture includes a wash bowl, a water supply assembly that supplies water to the wash bowl, a drainage assembly that drains the water, and a cabinet. An inner cabinet is provided under the wash bowl. An outer cabinet covers an outside of the inner cabinet. A dryer discharges air heated by a heater into the space defined in the cabinet. A first module is provided in the space defined in the inner cabinet, and an interior of the first module is dried using the air discharged from the dryer. A second module is provided in the space defined in the inner cabinet, and an interior of the second module is dried using air discharged from the first module. An external connection channel is defined between the inner cabinet and the outer cabinet to guide the air discharged from the first module to the second module.

20 Claims, 20 Drawing Sheets

(56) References Cited

U.S. PATENT DOCUMENTS

| | | | | |
|---|---|---|---|---|
| 2014/0366262 | A1 | 12/2014 | Flynn | |
| 2015/0252515 | A1* | 9/2015 | Henry | D06F 58/10 34/443 |
| 2016/0128528 | A1 | 5/2016 | Stewen et al. | |

* cited by examiner (a)

(b)

WASHSTAND FURNITURE

CROSS-REFERENCE TO RELATED APPLICATION(S)

This application claims the priority benefit of Korean Patent Application No. 10-2017-0029741, filed in Korea on Mar. 8, 2017 in the Korean Intellectual Property Office, the disclosure of which is incorporated herein by reference.

U.S. application Ser. Nos. 15/915,193; 15/915,364; 15/915,267; 15/915,332; 15/915,401; 15/915,480; 15/915,421; 15/915,216; 15/915,236, all filed on Mar. 8, 2018, are related and are hereby incorporated by reference in their entirety. Further, one of ordinary skill in the art will recognize that features disclosed in these above-noted applications may be combined in any combination with features disclosed herein.

BACKGROUND

1. Field

The present disclosure relates to washstand furniture that utilizes the space under a washstand, and more particularly to washstand furniture having a module received therein.

2. Background

Washstand furniture having modules received therein are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Exemplary embodiments of washstand furniture according to the present disclosure will be described with reference to the accompanying drawings.

A bathroom is a humid space in which water is constantly used. As a result, scaling is easily formed or mildew or bacteria easily propagate inside the bathroom or on articles disposed in the bathroom.

Since the bathroom is humid, mildew or bacteria may be generated in a storage space in which articles and utensils that are used in the bathroom are stored. Moreover, the bathroom has a relatively small storage space. For this reason, furniture is disposed in the space above or under a sink in order to provide a storage space. Such sinks having furniture may be referred to as a washstand furniture or simply a washstand or vanity. However, mildew or bacteria may be generated in such a space, since the bathroom is humid.

In particular, water supply and drainage facilities are disposed in washstand furniture (or washstand, vanity) disposed under the sink, whereby amount of the storage space is reduced. Furthermore, water from the sink may be easily introduced into the washstand and its various compartments. As a result, the interior of the washstand furniture may be contaminated, or articles and utensils disposed in the washstand furniture may also be contaminated or damaged due to water.

Hot air from an air conditioner may be discharged in order to dry the storage space in the washstand furniture. However, heating air to dry a single module is inefficient in terms of energy consumption. These and other disadvantages are addressed in the washstand furniture of the present disclosure.

Figure 1:
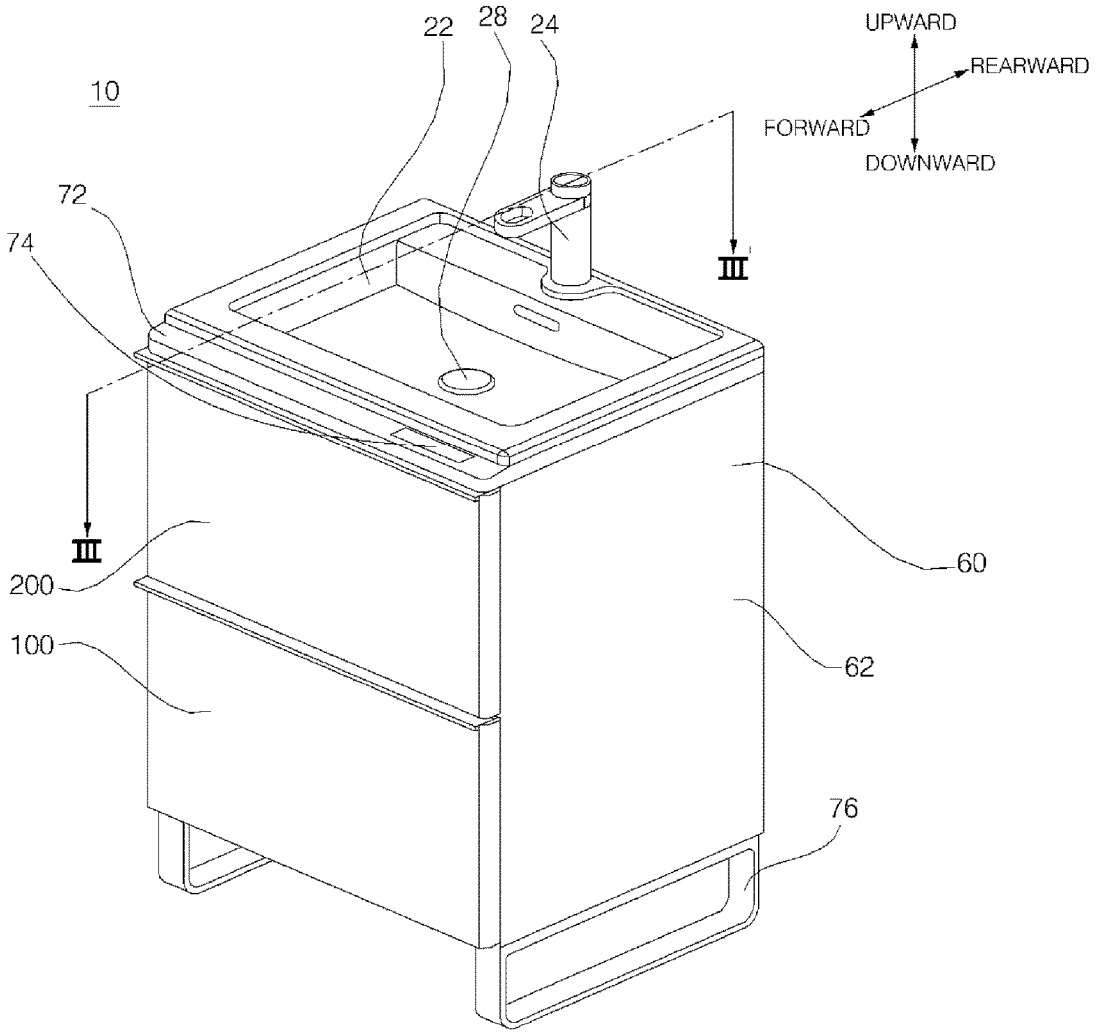
FIG. 1 is a perspective view showing washstand furniture according to an embodiment of the present disclosure.
Figure 2:
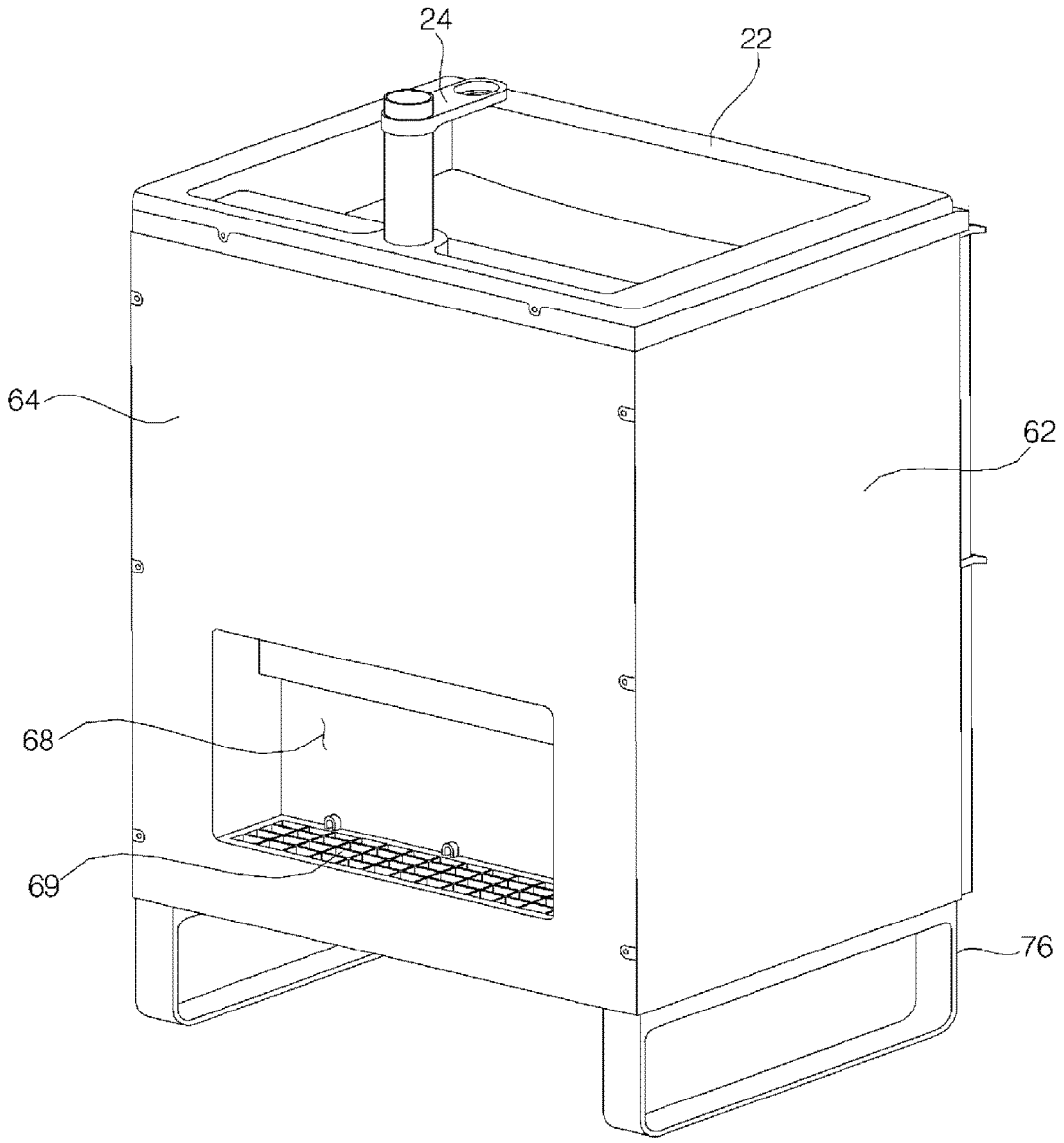
FIG. 2 is a rear perspective view showing the washstand furniture according to the embodiment of the present disclosure.
Figure 3:
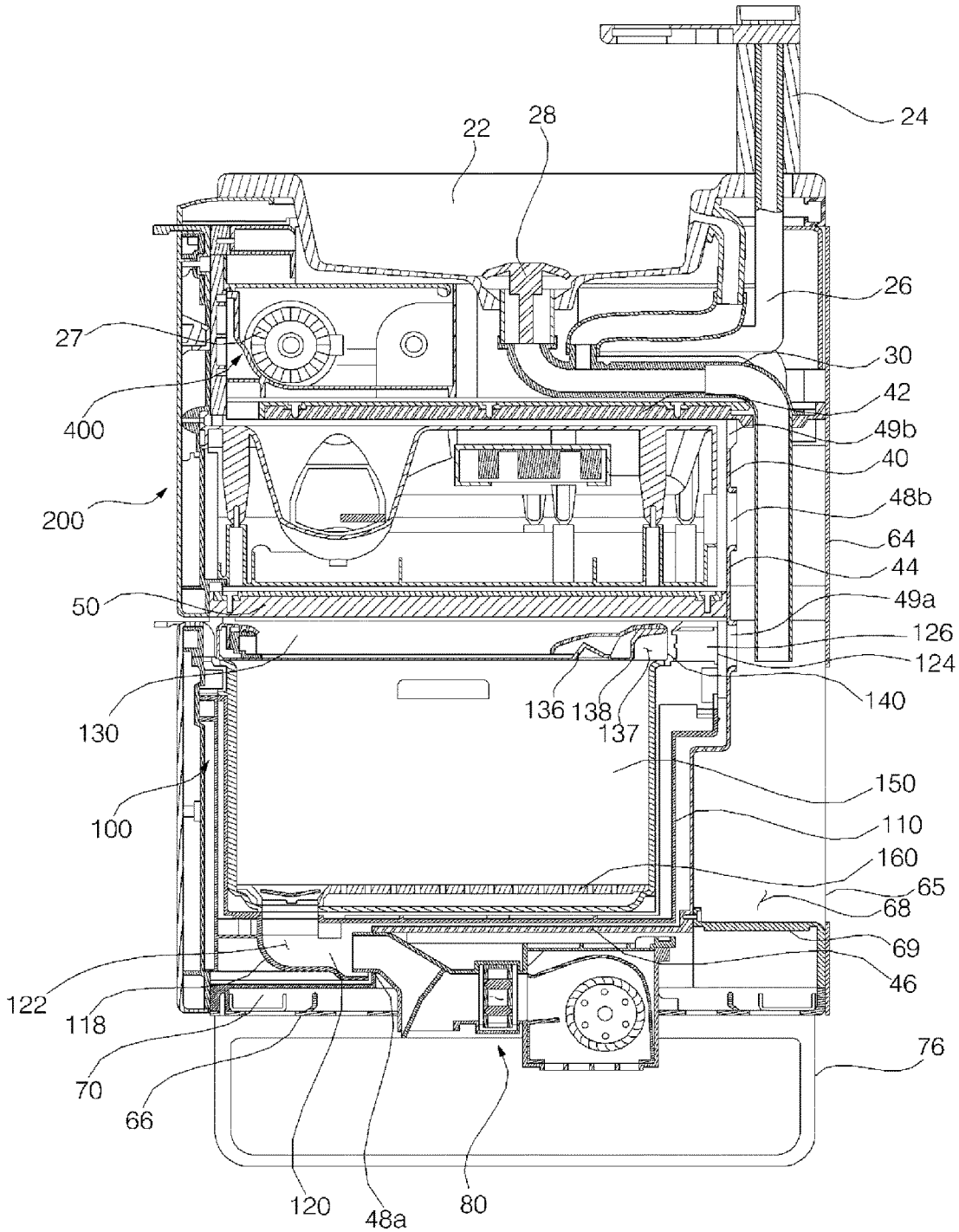
FIG. 3 is a sectional view taken along line III-III' of FIG. 1.
Figure 4:
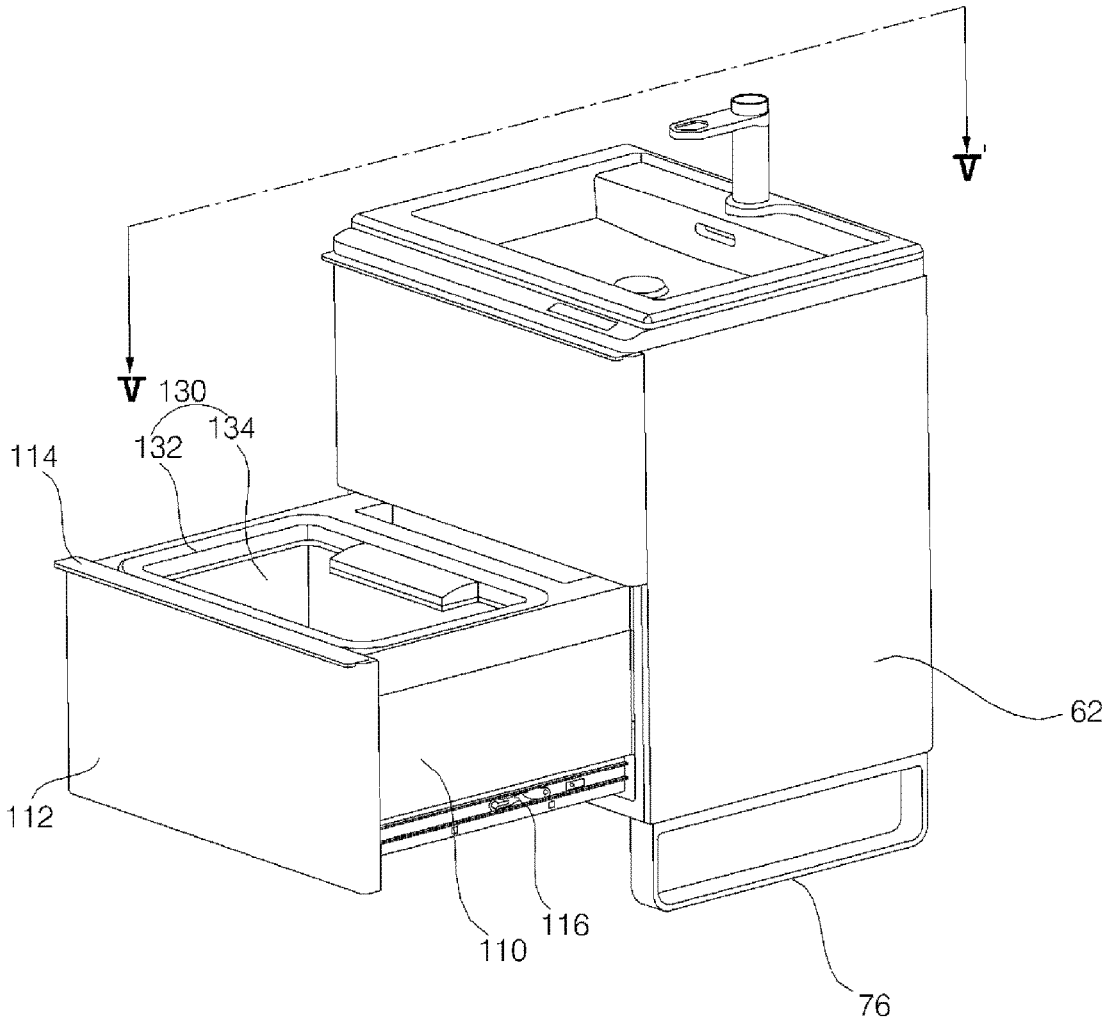
FIG. 4 is a view showing the state in which a first module of the washstand furniture according to the embodiment of the present disclosure is withdrawn.
Figure 5:
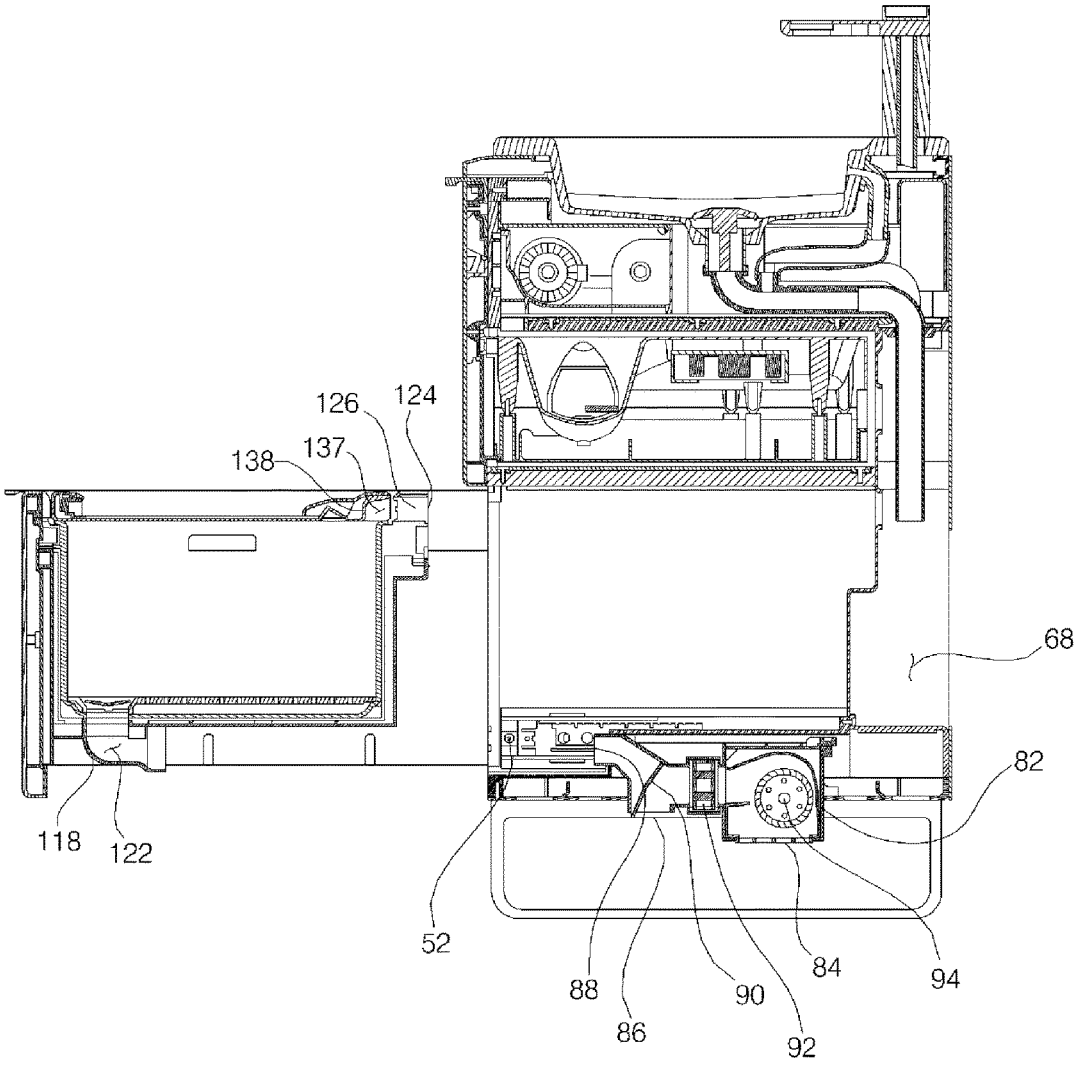
FIG. 5 is a sectional view taken along line V-V' of FIG. 4.

FIG. 1 is a perspective view showing washstand furniture according to an embodiment of the present disclosure. FIG. 2 is a rear perspective view showing the washstand furniture according to the embodiment of the present disclosure. FIG. 3 is a sectional view taken along line III-III' of FIG. 1. FIG. 4 is a view showing the state in which a first module of the washstand furniture according to the embodiment of the present disclosure is withdrawn. FIG. 5 is a sectional view taken along line V-V' of FIG. 4.

The washstand furniture 10 may include: a wash device including a wash bowl, a water supply assembly for supplying water to the wash bowl, and a drainage assembly for draining the water supplied to the wash bowl; an inner cabinet 40 disposed under the wash bowl, the inner cabinet having a space defined therein; an outer cabinet 60 for covering the outside of the inner cabinet; an air conditioner 80 (or dryer) for discharging air heated by a heater disposed therein into the space defined in the cabinet; a first module 100 disposed in the space defined in the inner cabinet, the interior of the first module being dried using the air discharged from the air conditioner; and a second module 200 disposed in the space defined in the inner cabinet, the interior of the second module being dried using the air discharged from the first module, wherein an external connection channel 68 (or external connection recess/path) for guiding the air discharged from the first module to the second module is defined between the inner cabinet and the outer cabinet.

Referring to FIG. 1, in the washstand furniture according to this embodiment, the direction in which the module is withdrawn from the cabinet will be referred to as a forward direction, the direction opposite the forward direction will be referred to as a rearward direction, the direction in which the wash bowl is disposed will be referred to as an upward direction, and the direction in which legs of the washstand furniture are disposed will be referred to as a downward direction, but the same are defined for convenience of description and are not intended to limit the scope of the disclosure.

The wash device is a device provided at the wall of a restroom, i.e. a washroom, for allowing a user to wash his/her face or hands. The wash device includes a wash bowl 22 (or sink, basin) for storing water necessary to perform washing, a water supply assembly for supplying water to the wash bowl 22, and a drainage assembly for draining the water supplied to the wash bowl 22.

An enamel wash bowl or a ceramic wash bowl may be used as the wash bowl 22. In this embodiment, an enamel wash bowl may be used, since the enamel wash bowl can be variably deformed and the lower part of the enamel wash bowl can be easily coupled to the cabinet. The wash bowl 22 may be disposed at the upper part of the washstand furniture 10.

The water supply assembly may include a water supply valve 24 for controlling the supply of water to the wash bowl 22 and a water supply hose 26 for supplying water to the water supply valve 24. The water supply valve 24 is disposed at one side of the wash bowl 22 for supplying water to the wash bowl 22. The water supply hose 26 may include a hot water hose for supplying hot water and a cold water hose for supplying cold water.

The water supply assembly may further include a water purification filter 27 for purifying the water that is introduced into the water supply hose 26. The water purification filter 27 purifies the water that is discharged to the wash bowl 22 via the water supply valve 24.

The drainage assembly may include a drainage pipe 30 for discharging the water stored in the wash bowl 22 to the outside and a popup valve 28 for storing the water in the wash bowl 22 or moving the water stored in the wash bowl 22 to the drainage pipe 30.

The cabinet, which defines the external appearance of the washstand furniture 10, may be disposed under the wash device. The cabinet maintains the rigidity of the washstand furniture 10 and has a space in which various modules may be received. In this embodiment, the interior of the cabinet is hollow, and the front of the cabinet is open.

The cabinet may include an inner cabinet 40 for receiving the module therein and an outer cabinet 60 disposed outside the inner cabinet 40 for maintaining the rigidity of the washstand furniture. The washstand furniture 10 may include an inner cabinet 40 and an outer cabinet 60 such that water is doubly prevented from being introduced into the module disposed in the inner cabinet 40.

The inner cabinet 40 may be formed in the shape of a box, the interior of which is hollow and the front of which is open. The outer cabinet 60 may be disposed outside the inner cabinet 40. The outer cabinet 60 may include a side-outer cabinet 62 (or side-outer cabinet wall) disposed so as to cover opposite side surfaces of the inner cabinet 40, a rear-outer cabinet 64 (or rear-outer cabinet wall) disposed so as to cover the rear surface 44 of the inner cabinet 40, and a base-outer cabinet 66 (or base-outer cabinet wall) disposed so as to cover the lower surface 46 of the inner cabinet 40. The rear-outer cabinet 64 is provided in one side thereof with a through-hole 65, through which the drainage pipe 30 of the drainage assembly or the water supply hose 26 of the water supply assembly extend outward.

In order to minimize the magnitude of the load of the wash device that is transmitted to the cabinet, the washstand furniture 10 may further include a frame 70 provided between the inner cabinet 40 and the outer cabinet 60. The frame 70 interconnects the inner cabinet 40 and the outer cabinet 60.

The module is received in the inner cabinet 40. In this embodiment, the module may be an electrically operated device received in the cabinet. A plurality of modules may be received in the cabinet.

The washstand furniture 10 may include a first module 100 and a second module 200, which are received in the inner cabinet 40. The first module 100 may be disposed at the lower part of the inner cabinet 40, and the second module 200 may be disposed at the upper part of the inner cabinet 40. The second module 200 may be disposed above the first module 100.

The washstand furniture 10 may further include a third module 400 disposed between the inner cabinet 40 and the wash bowl 22. The third module 400 may include a water purification filter 27 for purifying water that is supplied to the water supply assembly or a printed circuit board for controlling the electric power supplied to an air conditioner 80 or to the modules or controlling the operation thereof.

The washstand furniture 10 may include a partition 50 for partitioning the interior of the inner cabinet 40 into spaces for receiving a plurality of modules. The partition 50 partitions the interior of the inner cabinet 40 into spaces for receiving the modules. In this embodiment, the second module 200 is disposed in the inner cabinet 40 above the partition 50, and the first module 100 is disposed in the inner cabinet 40 under the partition 50. In addition, a wire for supplying electric power to the module configured to move forward from the interior of the cabinet may be disposed at the partition 50.

The inner cabinet 40 is provided on the inner surface thereof with a rail member 52 (or slide rails) for moving the modules 100 and 200 into the inner cabinet 40 or out of the inner cabinet 40. The first module 100 or the second module 200 may be disposed in the inner cabinet 40 so as to be withdrawn forward from the inner cabinet 40 along the rail member 52.

The external connection channel 68 communicating with the outside of the washstand furniture 10 may be defined between the inner cabinet 40 and the outer cabinet 60. The external connection channel 68 may be located between the rear surface 44 of the inner cabinet 40 and the rear-outer cabinet 64. The lower part of the external connection channel 68 may be open so as to communicate with the outside of the washstand furniture 10. The external connection channel 68 may be open toward the floor of a bathroom. Air discharged from the first module 100 flows to the floor of the bathroom via the external connection channel 68. The external connection channel 68 is may be vertically disposed along the first module 100 and the second module 200.

Under the external connection channel 68 may be disposed a support member 69 (or support, bracket) for maintaining the distance between the rear surface 44 of the inner cabinet 40 and the rear-outer cabinet 64. The support member 69 may be formed in a lattice shape to allow the external connection channel 68 to communicate with the outside of the washstand furniture 10 and to increase the rigidity of the washstand furniture. The support member 69 may be disposed under the external connection channel 68 to prevent external foreign matter from being introduced into the external connection channel 68.

The base-outer cabinet 66, which is disposed under the external connection channel 68, may be provided with a plurality of holes, through which air flows in the external connection channel 68 and the washstand furniture 10. The frame 70, which is disposed under the external connection channel 68, is also provided with a plurality of holes, through which air flows in the external connection channel 68 and the washstand furniture 10.

The inner cabinet 40 may be provided in at least one surface thereof with communication holes 48 and 49, through which air in the modules received therein flows to the outside of the inner cabinet 40. The inner cabinet 40 may be provided with a communication hole, through which the interior of the first module 100 or the interior of the second module 200 communicates with the external connection channel 68. In this embodiment, the inner cabinet 40 is provided in the rear surface 44 thereof with communication holes 48*b*, 49*a*, and 49*b*, through which the interiors of the modules communicate with the external connection channel 68. The communication holes include introduction holes 48*a* and 48*b* (or inlets) for introducing air into the modules and discharge holes 49*a* and 49*b* (or outlets) for discharging the air from the modules.

The inner cabinet 40 may be provided in the lower surface 46 or the rear surface 44 thereof with introduction holes 48*a* and 48*b* or discharge holes 49*a* and 49*b*. The inner cabinet 40 may be provided in the rear surface 44 thereof with a discharge hole 49*a* for discharging air from the first module 100 to the external connection channel, an introduction hole 48*b* for introducing air into the second module 200, and a discharge hole 49*b* for discharging the air from the second module 200 to the external connection channel. The inner cabinet 40 may be provided in the lower surface 46 thereof with an introduction hole 48*a* for introducing the air discharged from the air conditioner 80 into the first module 100.

The communication holes 48*b*, 49*a*, and 49*b*, formed in the rear surface 44 of the inner cabinet 40, allow communication between the interior of the inner cabinet 40 and the external connection channel 68.

Between the lower surface 46 of the inner cabinet 40 and the base-outer cabinet 66 is defined a space in which the air conditioner 80 is disposed. The lower surface 46 of the inner cabinet 40 is formed in a stepped shape so as to provide a space in which the air conditioner 80 is disposed at the lower side thereof. The communication hole 48*a*, which introduces air into the air conditioner 80, is formed in the portion of the lower surface 46 of the inner cabinet 40 that is stepped.

In this embodiment, the washstand furniture 10 includes an upper cover 72 disposed between the wash bowl 22 and the cabinet for primarily blocking water falling from the wash bowl 22. The upper cover 72 interconnects the wash bowl 22 and the cabinet. In this embodiment, the washstand furniture 10 may include an input unit 74 for allowing a user to input a command for operating the air conditioner 80 or the modules. In this embodiment, the input unit 74 is disposed at one side of the upper cover 72.

The input unit 74 may include a button-type switch, a membrane switch, or a touch panel for allowing a user to input a command for operating the modules or the air conditioner 80. Alternatively, a remote controller for allowing a user to input a command for operating the modules or the air conditioner 80 and displaying the operation of the modules or the air conditioner 80 may be included. In that case, the input unit 74 may include only a power button for supplying electric power to the modules or the air conditioner 80.

The washstand furniture 10 may further include legs for spacing the cabinet apart from the floor of the bathroom by a predetermined distance. The air conditioner 80 discharges air to dehumidify the floor of the bathroom or to dry the interiors of the modules disposed in the cabinet. The air conditioner 80 discharges air through a first discharge port 86 facing the floor of the bathroom or through a second discharge port 88 connected to the interior of the cabinet using a fan 94.

In this embodiment, the air conditioner 80 is disposed under the inner cabinet 40. The air conditioner 80 discharges air to the first module 100, which is disposed in the inner cabinet 40, from under the inner cabinet 40. The air conditioner 80 is disposed under the lower surface of the inner cabinet 40. The air conditioner 80 is disposed so as to be spaced apart from the floor of the bathroom by a predetermined distance. The air conditioner 80 is spaced apart from the floor of the bathroom by a predetermined distance to discharge air toward the floor of the bathroom. The air conditioner 80 is disposed between the lower surface of the inner cabinet 40 and the base-outer cabinet 66. A portion of a housing 82 of the air conditioner 80 protrudes toward the lower side of the base-outer cabinet 66. The air conditioner 80 is mounted to the base-outer cabinet 66.

The air conditioner 80 may include a housing 82 having therein a suction port 84, a first discharge port 86 for drying the floor of the bathroom, and a second discharge port 88 for drying the interiors of the modules disposed in the cabinet, a fan 94 disposed inside the housing 82 for moving air from the suction port 84 to the first discharge port 86 or to the second discharge port 88, and a vane 90 for discharging the air flowing in the housing 82 through the first discharge port 86 or through the second discharge port 88. The air conditioner 80 may further include a heater 92 for heating the air flowing therein. The air conditioner 80 may further include an air-conditioning filter for filtering the air that is suctioned into the suction port 84 of the housing 82. The air conditioner 80 may be various types of devices that condition the air including heating, filtering, sterilizing, cooling, or the like. In various embodiments, the air conditioner 80 may be referred to herein as a dryer, but it should be appreciated that a dryer may include various components to perform more than one function.

The vane 90 opens and closes the first discharge port 86 or the second discharge port 88. The vane 90 is driven by a vane-driving motor. The first discharge port 86 or the second discharge port 88 may be opened and closed by the operation of the vane-driving motor. The first discharge port 86 or the second discharge port 88 may be selectively opened and closed by the operation of the vane 90. When the first discharge port 86 is opened, the second discharge port 88 is closed. When the first discharge port 86 may be closed, the second discharge port 88 may be opened. It may be possible that both discharge ports 86, 88 are open for airflow in both directions.

The fan 94 moves air such that the air is suctioned through the suction port 84 and such that the air is discharged through the first discharge port 86 or the second discharge port 88. The suction port 84 of the air conditioner 80 is open toward the floor of the bathroom. When the fan 94 of the air conditioner 80 is operated, therefore, air is suctioned from the floor of the bathroom through the suction port 84, whereby dehumidification is achieved due to the convection of air along the floor of the bathroom.

In this embodiment, a cross-flow fan configured to suction air through the suction port 84 formed at the rear of the lower side of the housing 82 and to move the air to the discharge port formed at the front of the housing 82 may be used as the fan 94.

In this embodiment, a positive temperature coefficient resistance (PTC) heater, which functions as a self-temperature sensing heater that can be controlled so as to have an appropriate temperature based on general setting when electric power is supplied thereto without using an additional controller, may be used as the heater 92. In addition, the heater 92 may be disposed so as to occupy only a portion of the section of the channel defined in the housing 82, whereby channel resistance is minimized.

Figure 6:
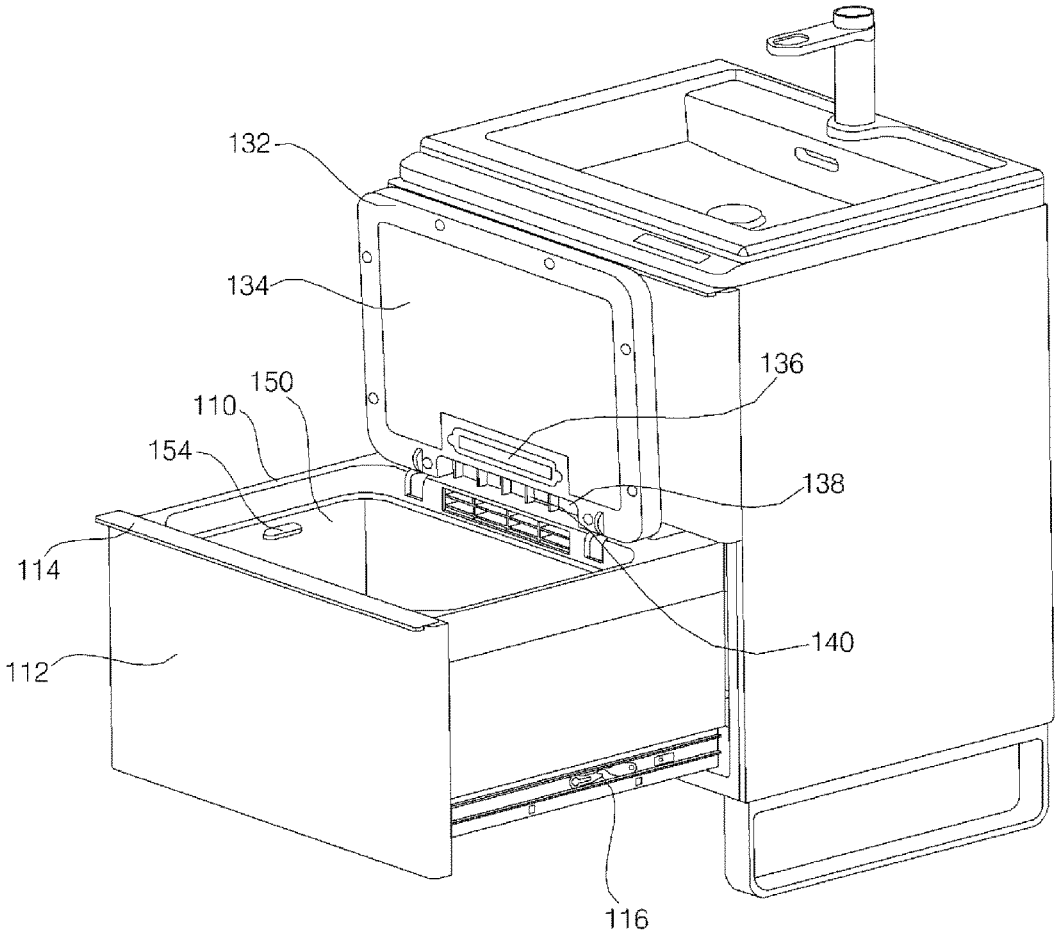
FIG. 6 is a view showing the state in which the first module according to the embodiment of the present disclosure is open.
Figure 7:
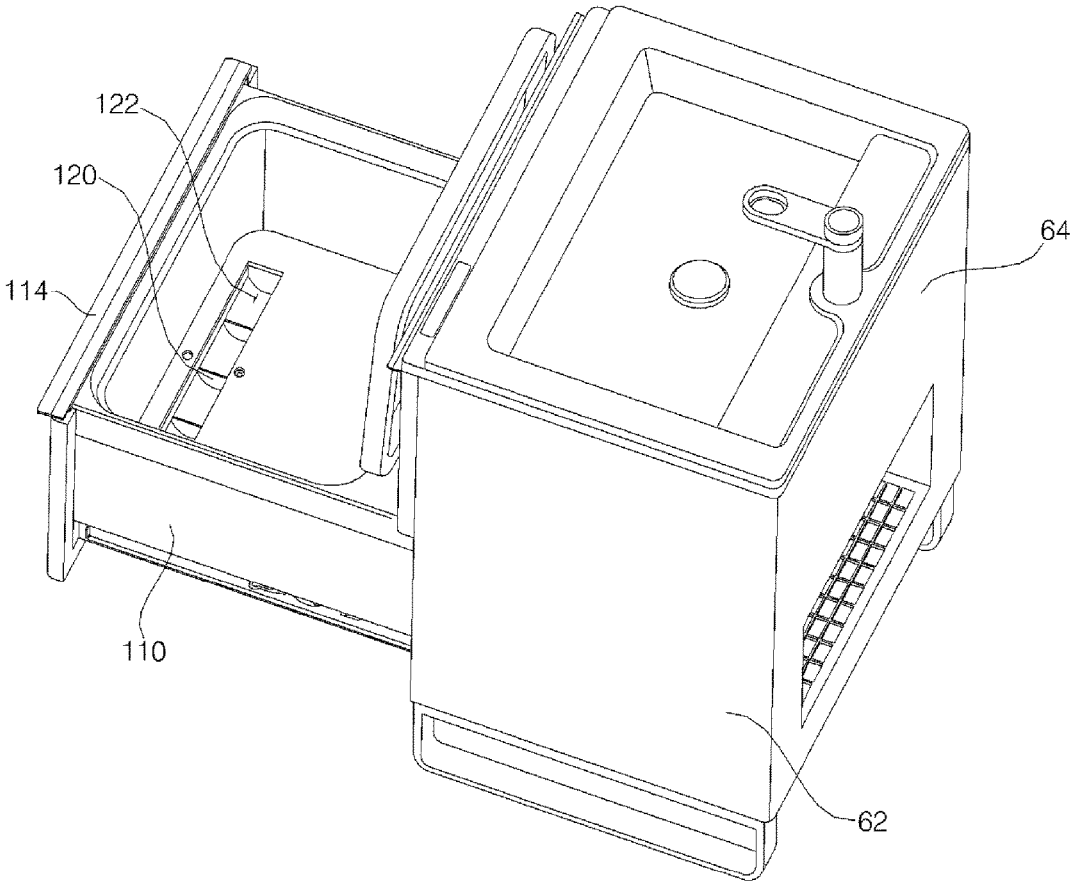
FIG. 7 is a view showing the state in which a basket and a rack are removed from the first module of FIG. 6.
Figure 8:
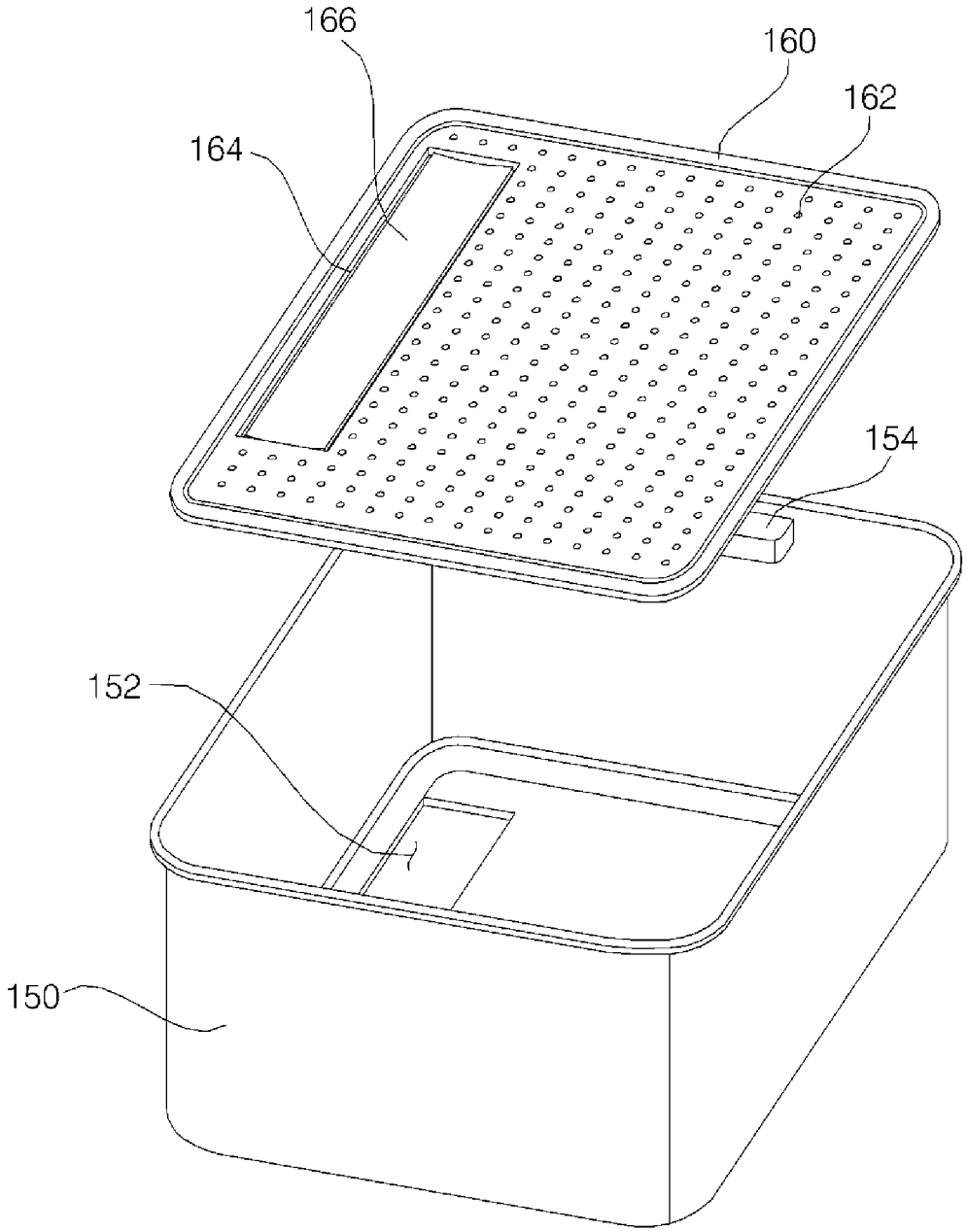
FIG. 8 is a view showing the state in which a basket and a rack according to an embodiment of the present disclosure are separated from each other.
Figure 9:
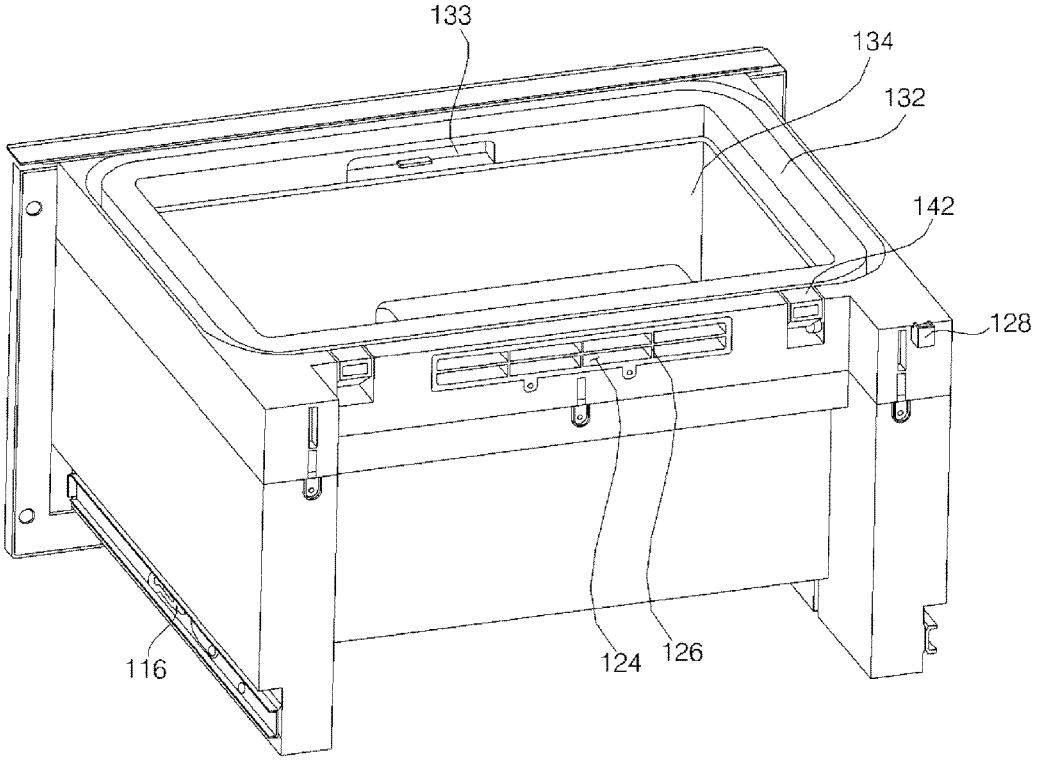
FIG. 9 is a rear perspective view showing the first module according to the embodiment of the present disclosure.
Figure 10:
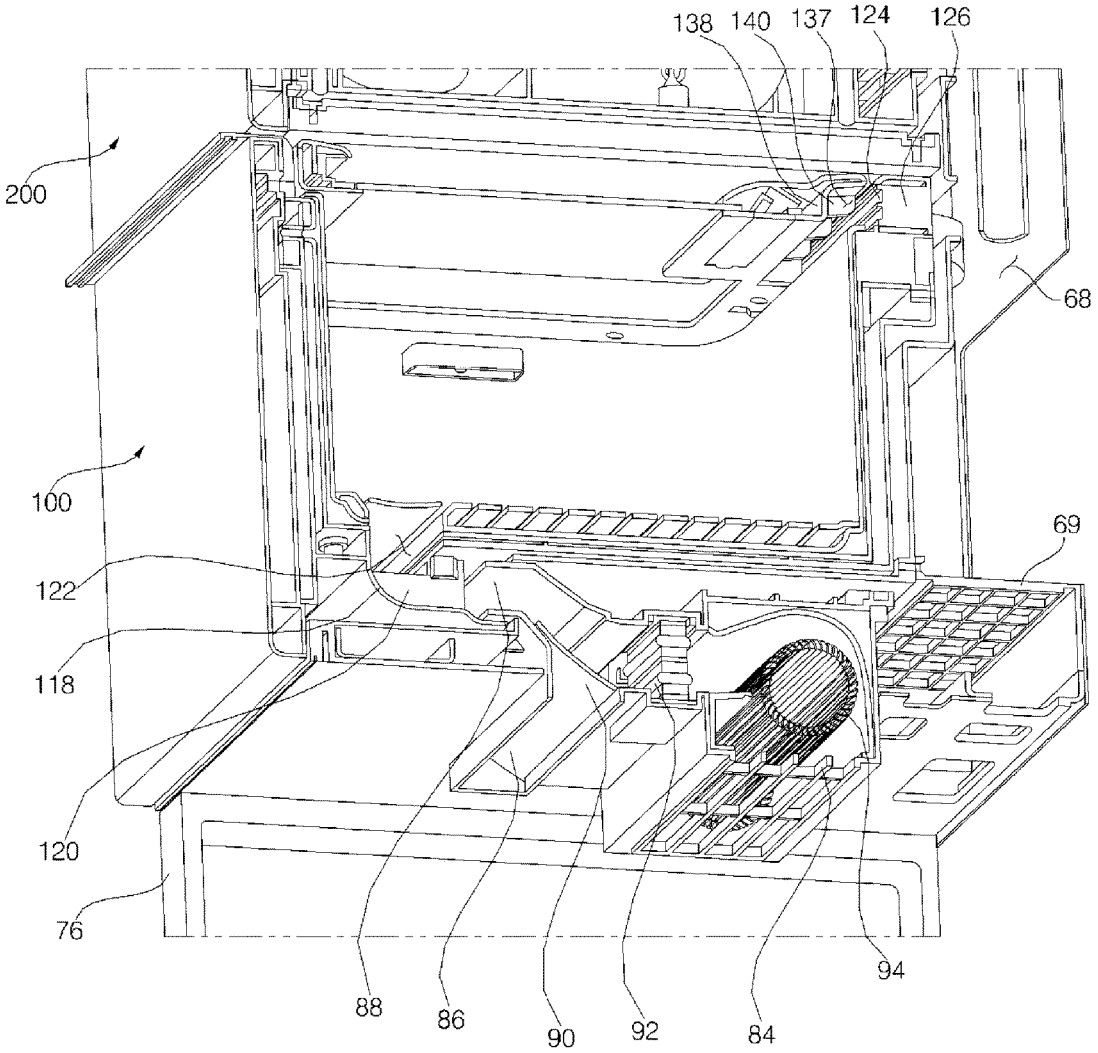
FIG. 10 is a view illustrating the connection relationship between an air conditioner of the washstand furniture according to the embodiment of the present disclosure and the first module.

FIG. 6 is a view showing the state in which the first module is open. FIG. 7 is a view showing the state in which a basket and a rack are removed from the first module of FIG. 6. FIG. 8 is a view showing the state in which a basket and a rack are separated from each other. FIG. 9 is a rear perspective view showing the first module. FIG. 10 is a view illustrating the connection relationship between an air conditioner of the washstand furniture and the first module.

The first module (or a "utensil-drying module") 100 may be used to dry utensils or other objects that are used in the bathroom. The first module 100 dries utensils received therein using hot air discharged from the air conditioner 80. The utensils used in the bathroom encompass a wide variety of tools that can be used in the bathroom. The first module 100 (and the second module 200) may configured as a drawer, and hence, may also be referred to herein as a heated drawer assembly.

The first module 100 may include a first module drawer 110 disposed so as to be movable between the interior of the cabinet and the front of the cabinet, the first module drawer having therein a space in which utensils are received, and a rack 160 disposed in the first module drawer 110 for holding utensils.

The first module 100 may further include a basket detachably disposed in the first module drawer 110. The interior of the first module drawer 72 may be hollow, and the top of the first module drawer 72 may be open. The basket 150 may be inserted or removed through the open top of the first module drawer 110. The rack 160 may be disposed in the basket 150.

The first module 100 may further include a first module suction member 118 (or connection duct, air inlet) having therein a suction channel 122 connected to the air conditioner 80 and a discharge member 126 having a discharge port for discharging air from the first module 100.

The first module 100 may include a first module front part 112 disposed at the front of the first module drawer 110 and a first module handle 114 protruding forward from the upper end of the first module front part 112. The first module front part 112 may be disposed at the front of the washstand furniture 10. The first module front part 112 covers the front of the cabinet in the state in which the first module drawer 110 is inserted into the cabinet. The first module handle 114 may protrude such that a user can withdraw the module to the front of the cabinet.

The first module drawer 110 may be formed in an approximate box shape. The interior of the first module drawer 110 may be hollow, and the upper side of the first module drawer 110 may be open. The first module drawer 110 may be provided at the upper side thereof with a door 130 for opening and closing the open upper side of the first module drawer 110. The door 130 may be hingedly connected to the upper side of the first module drawer 110.

The first module 100 may further include a hinge assembly 142 for opening and closing the door 130 at the upper side of the first module drawer 110. The hinge assembly 142 turns the door 130 such that the door 130 opens and closes the upper side of the first module drawer 110. A wire from the first module drawer 110 may extend through the hinge assembly 142 such that the wire is connected to a first module ultraviolet lamp 136 disposed at the door 130. When the door 130 is opened at the upper side of the first module drawer 110, the basket 150 may be inserted into the first module drawer 110 or separated from the first module drawer 110.

The door 130 may include a shielding part 134 for shielding the open upper side of the first module drawer 110 and an edge part 132 disposed around the shielding part 134 for sealing the upper side of the first module drawer 110. A transparent window, through which the interior of the first module drawer 110 can be checked with the naked eye, may be used as the shielding part 134. The shielding part 134 may be made of transparent glass or plastic.

When the door 130 is closed, the part of the door 130 that is located inside the first module drawer 110 will be referred to as the inside of the door 130, and the part of the door 130 that is located outside the first module drawer 110 will be referred to as the outside of the door 130. However, the same are defined for convenience of description and are not intended to limit the scope of the disclosure.

The door 130 is provided at the outside thereof with a door handle 133 for opening and closing the door 130. In this embodiment, the door handle 133 is formed at the outside of the edge part 132.

The door 130 may be provided at the part thereof that is adjacent to the discharge member 126 with a discharge port connection recess 138, which is recessed such that the air in the first module 100 flows to the discharge port 124. The discharge port connection recess 138 may be recessed inward of the edge part 132 at the part thereof that is adjacent to the discharge member 126 in order to define a discharge port connection channel 137, through which the air in the first module 100 flows to the discharge port 124 in the discharge member 126.

The edge part 132 may include a discharge port connection recess support member 140 for maintaining the rigidity of the edge part 132 at the portion thereof at which the discharge port connection recess 138 is formed. A plurality of discharge port connection recess support members 140 may be formed side by side while extending toward the discharge port 124. The discharge port connection recess support members 140 guide air flowing in the discharge port connection channel 137 to the discharge port 124.

The door 130 may further include an ultraviolet lamp for sterilizing the utensils disposed in the first module drawer 110. The ultraviolet lamp may be disposed at the inside of the door 130. A first module ultraviolet lamp 136 for sterilizing the utensils disposed in the first module drawer 110 is disposed at the inside of the edge part 132.

The first module 100 may include a first-module-moving rail 116 for inserting the first module drawer 110 into the cabinet or withdrawing the first module drawer 110 from the cabinet. The first-module-moving rail 116 may be disposed on the side surface of the first module drawer 110. The first-module-moving rail 116 moves along a rail member 56 of the inner cabinet 40. As the first-module-moving rail 116 of the first module drawer 110 moves along the rail member 56 of the inner cabinet 40, the first module drawer 110 is inserted into or withdrawn from the inner cabinet 40.

The first module drawer 110 includes a wire connection member 128 (or wire connection harness) for connecting a wire extending from the cabinet or the partition 50 to the interior of the first module drawer 110. The wire connection member 128 protrudes from one side of the first module drawer 110 toward the cabinet or the partition 50. In this embodiment, the wire connection member 128 protrudes from the rear of the first module drawer 110 and is bent toward the partition 50.

The wire may be connected to the interior of the first module drawer 110 through the wire connection member 128. The wire connected to the interior of the first module drawer 110 through the wire connection member 128 may be connected to a first module ultraviolet lamp 136, which will be described in detail below. The wire connected to the wire connection member 128 extends into the edge part 132 of the door 130 through the hinge assembly 142 so as to be connected to the first module ultraviolet lamp 136.

The first module drawer 110 may include a first module suction member 118 (or inlet, duct) for moving the air discharged from the air conditioner 80 into the first module drawer 110. In this embodiment, the first module suction member 118 may be disposed at the lower side of the first module drawer 110. The first module suction member 118 moves the hot air discharged from the air conditioner 80 into the first module 100. The end of the first module suction member 118 may be connected to the discharge port of the air conditioner 80.

The first module suction member 118 has therein a suction channel 122 for guiding the air discharged from the air conditioner 80 into the first module 100. A suction channel support member 120 for supporting the suction channel 122 may be disposed in the first module suction member 118. The suction channel support member 120 may guide the air flowing in the suction channel 122.

In the state in which the first module drawer 110 is inserted into the cabinet, the first module suction member 118 is connected to the air conditioner 80. Specifically, as shown in FIG. 2, a portion of the housing 82 of the air conditioner 80 forming the circumference of the second discharge port 88 may be inserted into the suction channel 122 in the first module suction member 118 via the communication hole 48*a* in the inner cabinet 40.

The suction channel 122 formed in the end of the first module suction member 118 may be formed so as to be parallel to the direction in which the first module drawer 110 moves along the first-module-moving rail 116. The suction channel 122 may be connected to the air conditioner 80 in the state in which the first module drawer 110 is inserted into the inner cabinet 40.

The first module drawer 110 may include a discharge member 126 having therein a discharge port 124 for discharging air from the module. The discharge member 126 may be separated from the first module drawer 110. Alternatively, the discharge member 126 may be integrally formed with the first module drawer 110.

The discharge member 126 may be disposed at the upper side of the first module drawer 110. The discharge member 126 is formed so as to correspond to the communication hole 49*a* formed in the inner cabinet 40. The discharge member 126 may be disposed at the upper side of the rear surface of the first module drawer 110. The discharge member 126 may be disposed higher than the basket 150, which is received in the first module drawer 110. The discharge member 126 may be disposed at the same height as the part of the first module drawer 110 at which the door 130 is disposed. At the part at which the discharge member 126 is disposed, the door 130 may be provided at the inside thereof with a space in which air flows from the module to the discharge port 124.

The basket 150 may be received in the first module drawer 110. The basket 150 may be inserted into the first module drawer 110, or may be withdrawn from the first module drawer 110 through the open upper side of the first module drawer 110. The interior of the basket 150 is hollow, and the upper side of the basket 150 is open. The basket 150 has therein a space in which objects to be dried, i.e. utensils, are received.

The basket 150 may be provided in one side of the lower surface thereof with a lower hole 152. The lower hole 152 is connected to the suction channel 122 in the first module suction member 118. Air discharged from the air conditioner 80 may be introduced into the basket 150 through the suction channel 122 and the lower hole 152.

A basket handle 154 may be formed at the side of the basket 150 so as to protrude inward. A user may withdraw the basket 150 from the first module drawer 110 using the basket handle 154.

The rack 160 may be a member for holding utensils. The rack 160 is disposed in the basket 150 such that water falling from the utensils flows to the lower surface of the basket 150. The rack 160 may be spaced apart from the lower surface of the basket 150 by a predetermined distance.

The rack 160 may be disposed at the lower part of the basket 150 inside the basket 150. The rack 160 may be provided with a plurality of hollow holes 162, through which the water that has fallen from the utensils disposed in the basket 150 flows to the lower surface of the basket 150. The rack 160 may be provided with a plurality of hollow holes 162, through which the upper side of the rack in which the utensils are held and the lower side of the rack facing the lower surface of the basket 150 communicate with each other.

The rack 160 may be provided at the part thereof corresponding to the lower hole 152 in the basket 150 with an air flow hole 164. The air flow hole 164 may be connected to the suction channel 122 in the first module suction member 118 of the first module drawer 110. Air discharged from the air conditioner 80 is introduced into the basket 150 through the air flow hole 164 in the rack 160. Hot air introduced into the basket 150 dries the utensils held in the rack 160.

The rack 160 includes a flow hole cover 166 for covering the air flow hole 164. The flow hole cover 166 is disposed above the air flow hole 164. The flow hole cover 166 prevents the utensils held in the rack 160 from falling into the suction channel 122 through the air flow hole 164.

Figure 11:
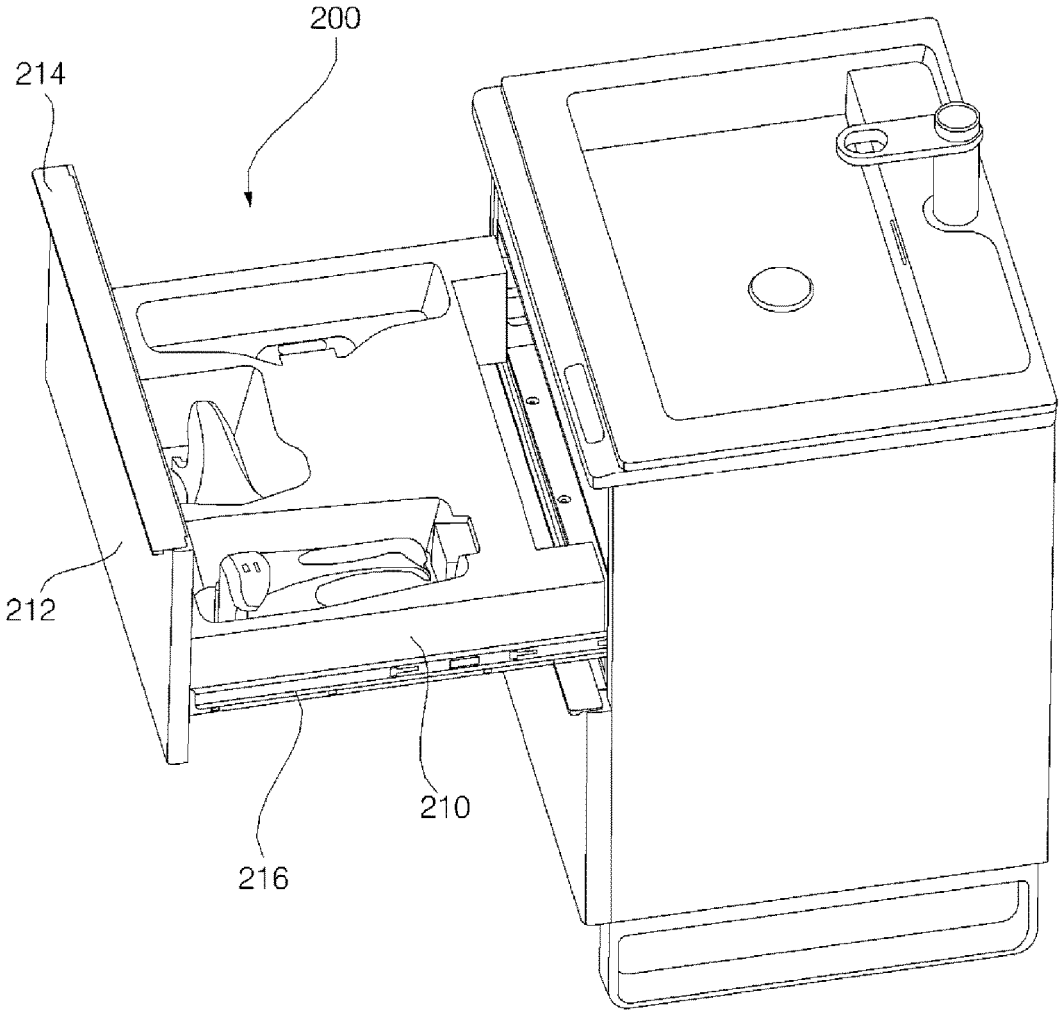
FIG. 11 is a view showing the state in which a second module of the washstand furniture according to the embodiment of the present disclosure is withdrawn.
Figure 12:
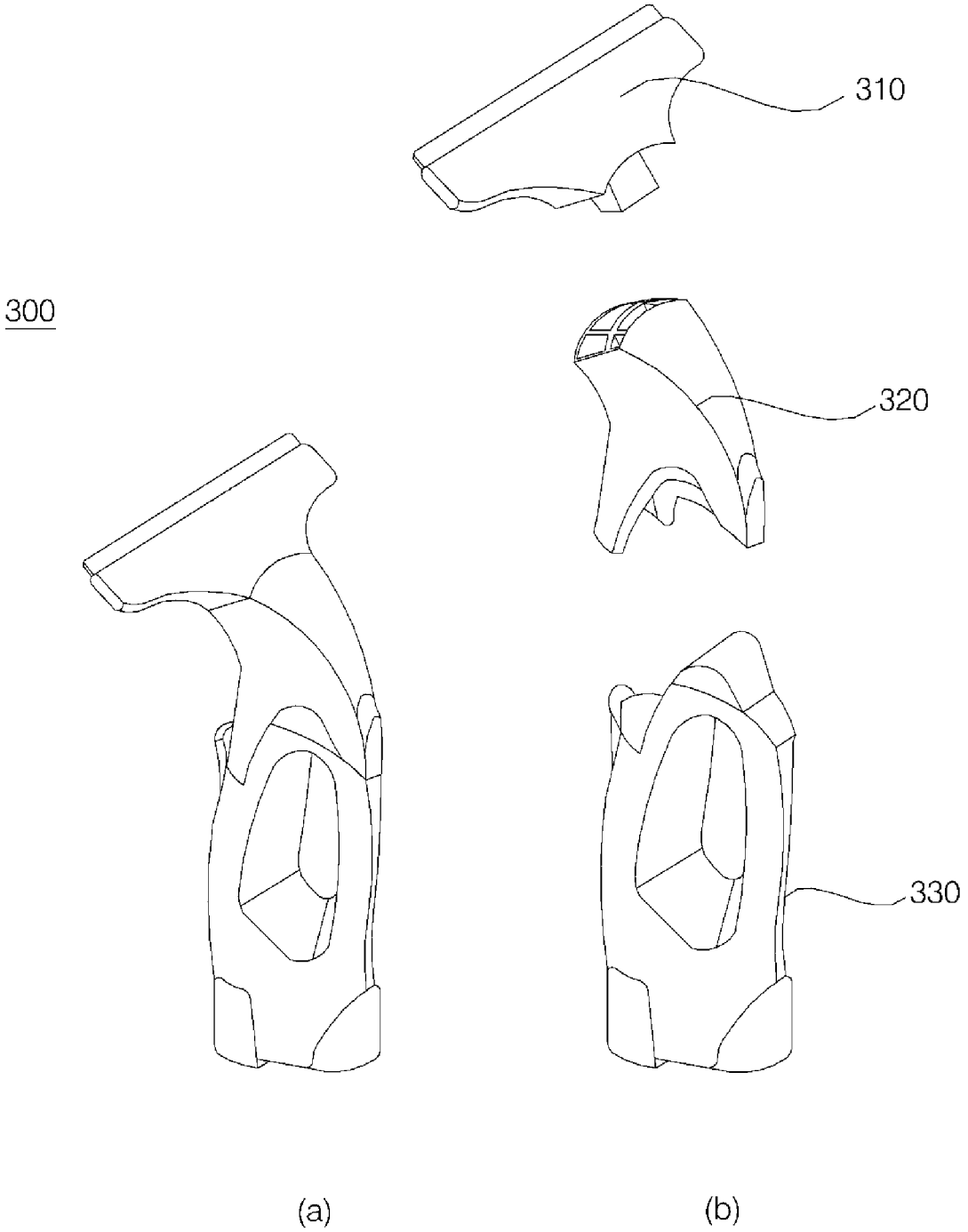
FIG. 12 is a view showing a residual water suction device received in the second module according to the embodiment of the present disclosure.
Figure 13:
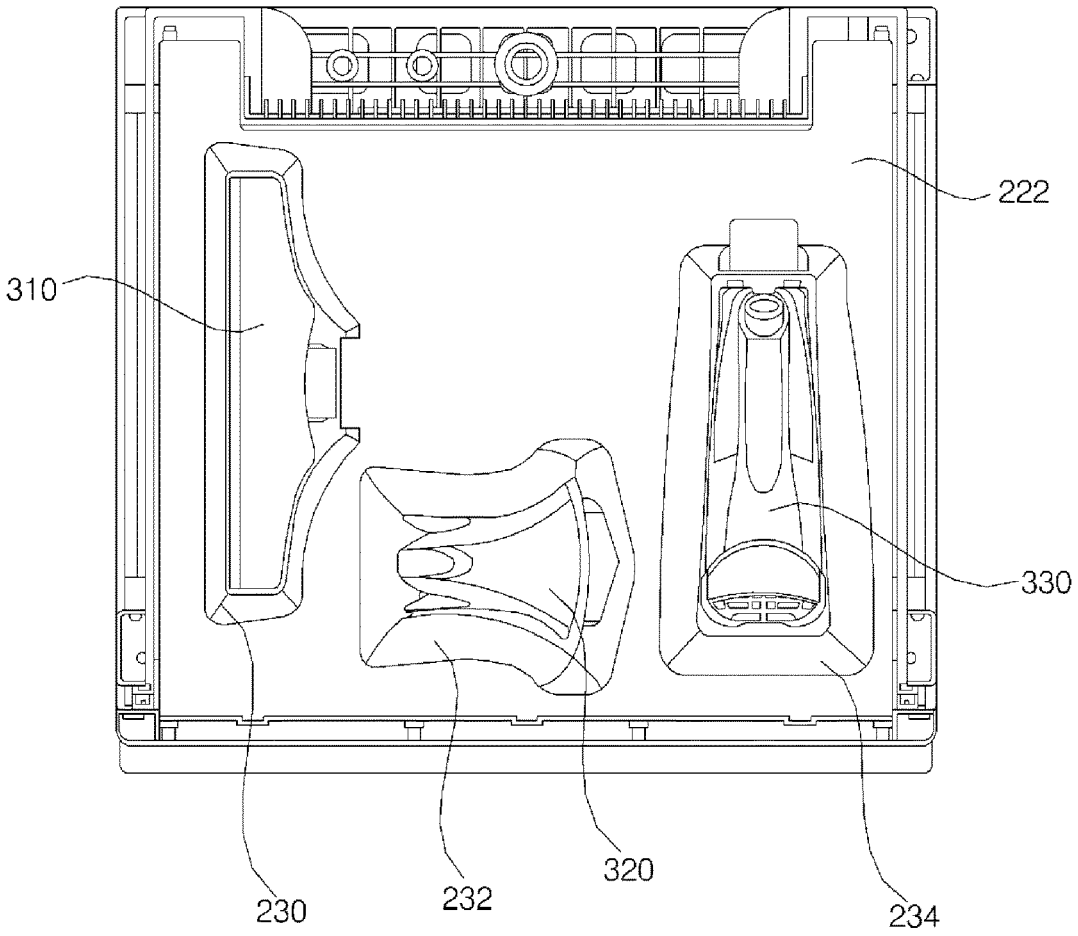
FIG. 13 is a view illustrating a plurality of reception units of the second module according to the embodiment of the present disclosure.
Figure 14:
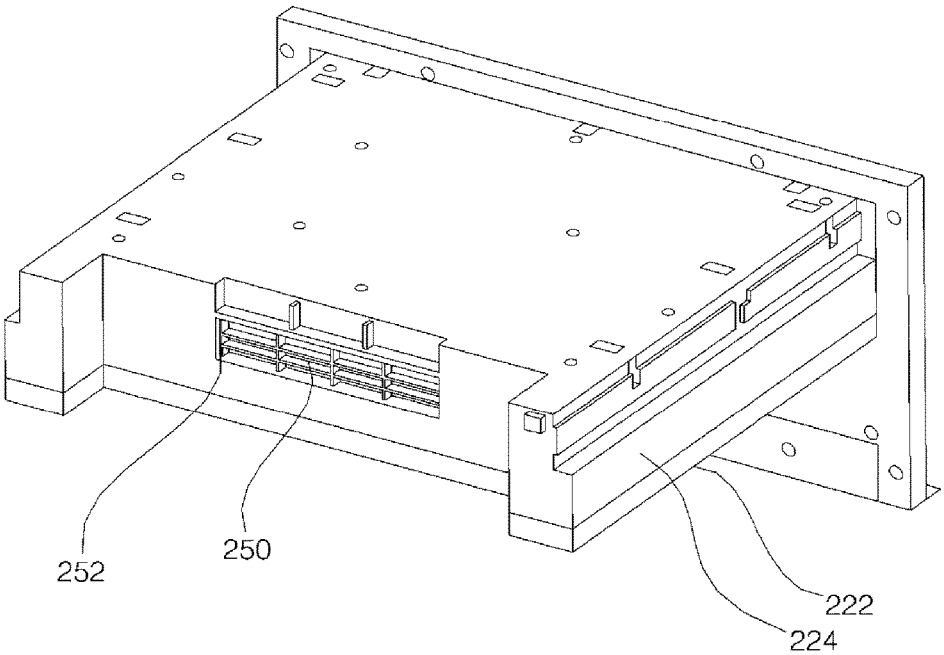
FIG. 14 is a view illustrating a lower cover and an upper cover of the second module according to the embodiment of the present disclosure.
Figure 14:
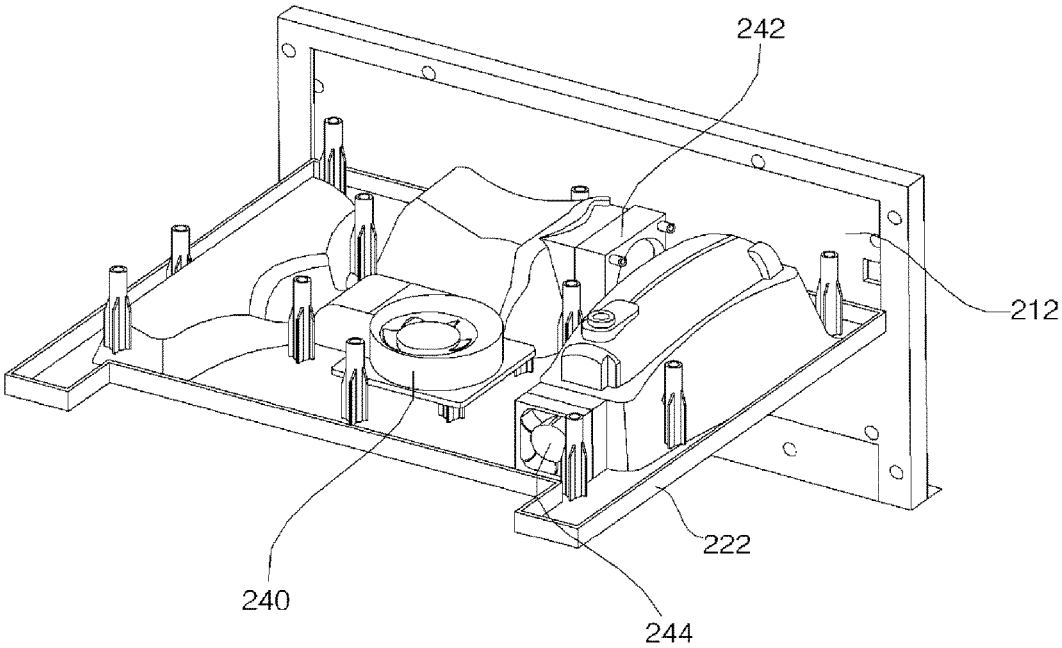

FIG. 11 is a view showing the state in which the second module of the washstand furniture is withdrawn. FIG. 12 is a view showing a residual water suction device received in the second module. FIG. 13 is a view illustrating a plurality of reception units of the second module. FIG. 14 is a view illustrating a lower cover 224 and an upper cover 222 of the second module 200.

A residual water suction device 300, which can be used in the bathroom, may be received in the second module (or the "residual-water-suction-device-drying module") 200. The second module 200 removes residual moisture from the residual water suction device 300. The second module 200 charges a rechargeable battery in the residual water suction device 300.

First, the residual water suction device 300, which is received in the second module 200, will be described with reference to FIG. 12. The residual water suction device 300 removes residual water from the wall of the bathroom by suctioning the same. In this embodiment, the residual water suction device 300 may include a main body 330 having a suction module for suctioning a fluid, a liquid-gas separator 320 (or dehumidifier) connected to the main body 330 for separating the suctioned fluid into gas and liquid, and a suction nozzle 310 having a suction port for suctioning the fluid through the operation of the suction module. The main body 330 may include a drainage water tank connected to the liquid-gas separator 320 for storing the separated liquid. The main body 330 may further include a rechargeable battery for supplying electric power to the suction module of the residual water suction device 300 and an electric power reception unit for receiving external electric power.

The residual water suction device 300 may be divided into the suction nozzle 310, the liquid-gas separator 320, and the main body 330. The second module 200 receives therein the suction nozzle 310, the liquid-gas separator 320, and the main body 330 of the residual water suction device 300 in order to dry the suction nozzle 310, the liquid-gas separator 320, and the main body 330.

The second module 200 has a plurality of receiving spaces for receiving the separate components of the residual water suction device 300. Referring to FIG. 13, the second module 200 may include a first reception unit 230 (or first reception recess) for receiving the suction nozzle 310, a second reception unit 232 (or second reception recess) for receiving the liquid-gas separator 320, and a third reception unit 234 (or third reception recess) for receiving the main body 330. The second module 200 includes a first fan 240 for moving air to the first reception unit 230, a second fan 242 for moving air to the second reception unit 232, and a third fan 244 for moving air to the third reception unit 234.

The second module 200 may include a second module drawer 210, which is movably disposed in the cabinet and which defines a plurality of reception units 230, 232, and 234 for receiving the separate components of the residual water suction device 300, and a plurality of fans 240, 242, and 244 for moving air to the respective reception units. The second module 200 includes a second module front part 212 disposed at the front of the second module drawer 210 and a drawer handle 214 protruding from the upper end of the second module front part 212. The second module front part 212 covers the open front of the cabinet.

A portion of the upper surface of the second module drawer 210 may be recessed inward to define the reception units or recesses. The fans 140, 142, and 144 for moving air to the reception units 230, 232, and 234, respectively, are disposed in the second module drawer 210.

The second module drawer 210 may be provided at the rear thereof with a second module suction member 252 (or grill) having a suction port 250, through which air flows into the second module drawer 210. Referring to FIG. 14, the second module suction member 252 may be a member that is separated from the second module drawer 210 and is disposed at one side of the second module drawer 210. Alternatively, the second module suction member 252 may be integrally formed with the second module drawer 210. Air from the external connection channel 68 is introduced into the second module 200 through the second module suction member 252. The communication hole **48*b* may be formed in the inner cabinet 40 at a position corresponding to the suction port 250 of the second module drawer 210**.

The second module 200 may include a second-module-moving rail 216 for inserting the second module drawer 210 into the cabinet or withdrawing the second module drawer 210 from the cabinet. In this embodiment, the second-module-moving rail 216 is disposed on the side surface of the second module drawer 210. A rail member may be disposed inside the inner cabinet 40 at a position corresponding to the second-module-moving rail 216. As the second-module-moving rail 216 of the second module drawer 210 moves along the rail member of the inner cabinet 40, the second module drawer 210 may be inserted into or withdrawn from the inner cabinet 40.

The second module drawer 210 may further include a wire connection member (or wire connection harness) for connecting an electric power supply wire to the interior of the second module drawer 210. The wire connection member may be connected to the cabinet or the partition 50. The wire is connected to the interior of the second module 200 through the wire connection member.

The wire connection member may be disposed at the rear surface of the second module drawer 210. The wire disposed in the second module drawer 210 through the wire connection member supplies electric power to an ultraviolet lamp 218, which will be described in detail below, and to the fans.

Referring to FIG. 14, the second module drawer 210 may include an upper cover 222, which defines the upper surface of the second module drawer 210, and a lower cover 224, which defines the side surfaces, the rear surface, and the lower surface of the second module drawer 210. The upper cover 222 and the lower cover 224 may be coupled to each other to define an internal channel 226 for suctioning air flowing in the external connection channel 68. The fans 240, 242, and 244 may be disposed in the internal channel 226, which is defined by the coupling between the upper cover 222 and the lower cover 224.

The second module suction member 252, which has the suction port 250 therein for allowing the air in the external connection channel 68 to be introduced into the internal channel 226 of the second module drawer 210 therethrough, is disposed at one side of the lower cover 224. A portion of the upper cover 222 may be recessed downward to define the reception units for receiving the separate components of the residual water suction device 300. The upper cover 222 may be provided therein with a plurality of holes 246, 247, and 248, through which the air in the internal channel 226 flows to the respective reception units 230, 232, and 234 due to the operation of the fans 240, 242, and 244.

Figure 18:
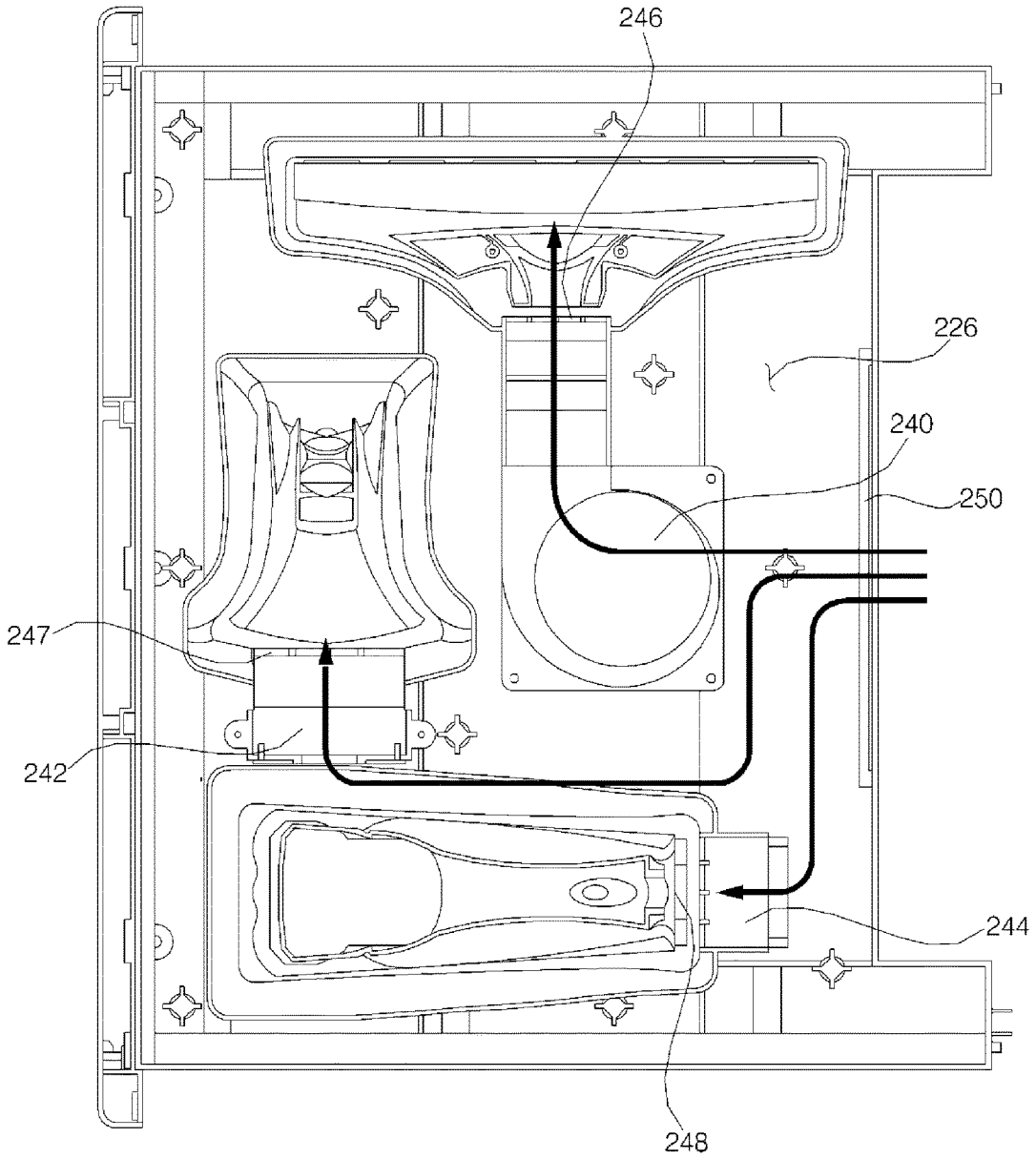
FIG. 18 is a view illustrating air flowing to a plurality of receiving units in an inner channel of the second module according to the embodiment of the present disclosure.

Referring to FIG. 18, the first reception unit 230 may have a first hole 246 formed in the direction in which the first fan 240 is disposed. The second reception unit 232 may have a second hole 247 formed in the direction in which the second fan 242 is disposed. The third reception unit 234 may have a third hole 248 formed in the direction in which the third fan 244 is disposed.

The upper cover 122 of the second module drawer 210 may be disposed so as to be spaced apart from the upper surface 42 of the inner cabinet 40 by a predetermined distance. Between the upper cover 222 of the second module drawer 210 and the upper surface 42 of the inner cabinet 40 may be defined a discharge channel 260, along which the air discharged into the reception units by the fans flows. The communication hole 49*b*, through which the air flowing in the discharge channel 260 is discharged to the external connection channel 68, may be formed in the upper end of the side surface of the inner cabinet 40.

The second module 200 may further include a second module ultraviolet lamp 218 for sterilizing the separate components of the residual water suction device 300 disposed in the second module drawer 210. The second module ultraviolet lamp 218 may be disposed inside the second module front part 212. Alternatively, ultraviolet lamps may be disposed in the respective reception units, in which the separate components of the residual water suction device 300 are disposed.

Figure 15A:
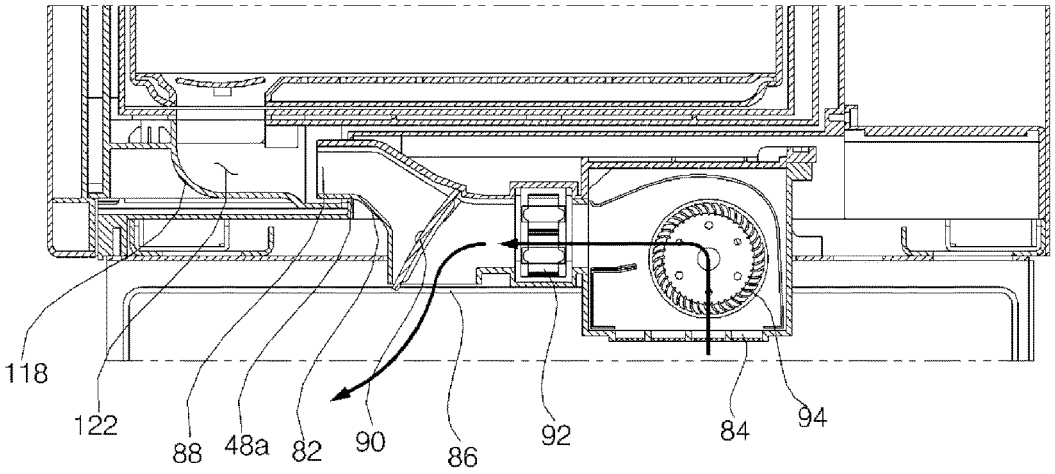
FIG. 15A is a view illustrating the flow of air in the air conditioner according to the embodiment of the present disclosure in a bottom dehumidification mode.
Figure 15B:
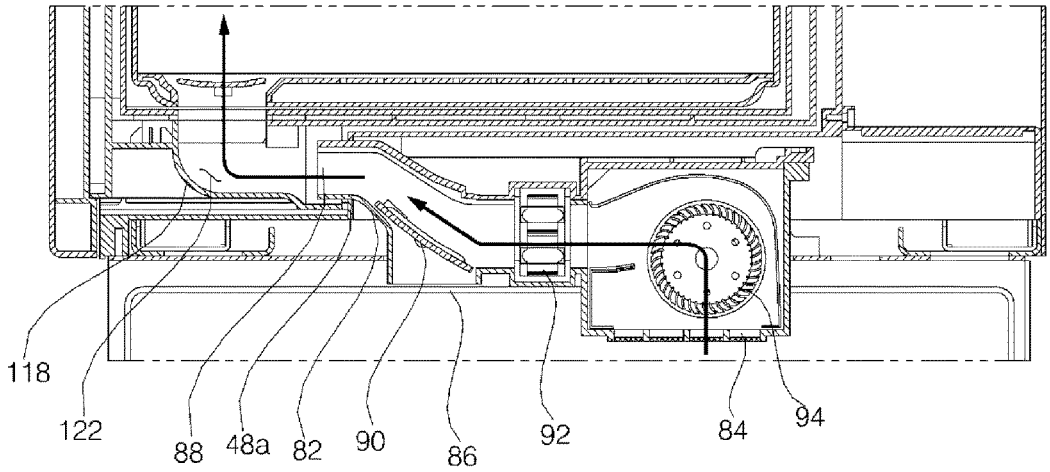
FIG. 15B is a view illustrating the flow of air in the air conditioner according to the embodiment of the present disclosure in a module-drying mode.
Figure 16:
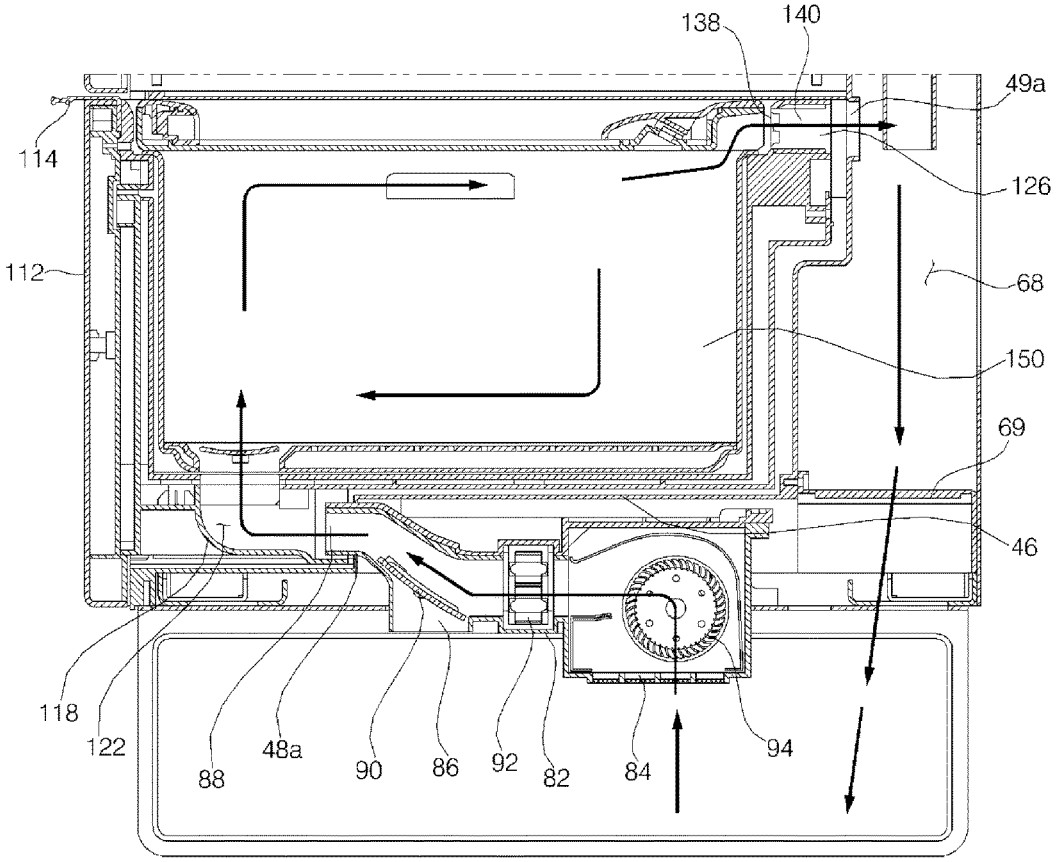
FIG. 16 is a view showing the flow of air in the first module due to the operation of the air conditioner in FIG. 15B.
Figure 17:
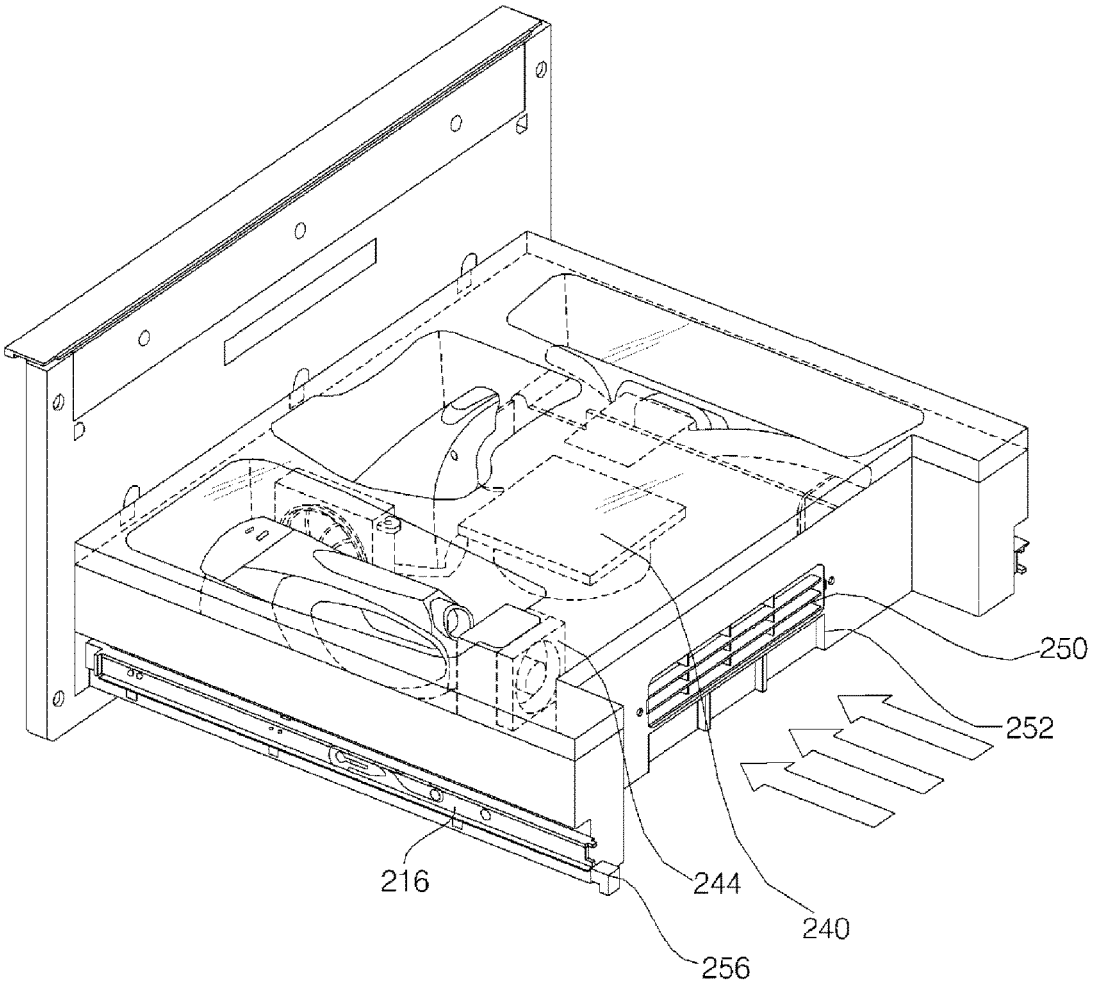
FIG. 17 is a view illustrating air flowing to a plurality of fans and suction ports disposed between an upper cover and a lower cover according to an embodiment of the present disclosure.
Figure 19:
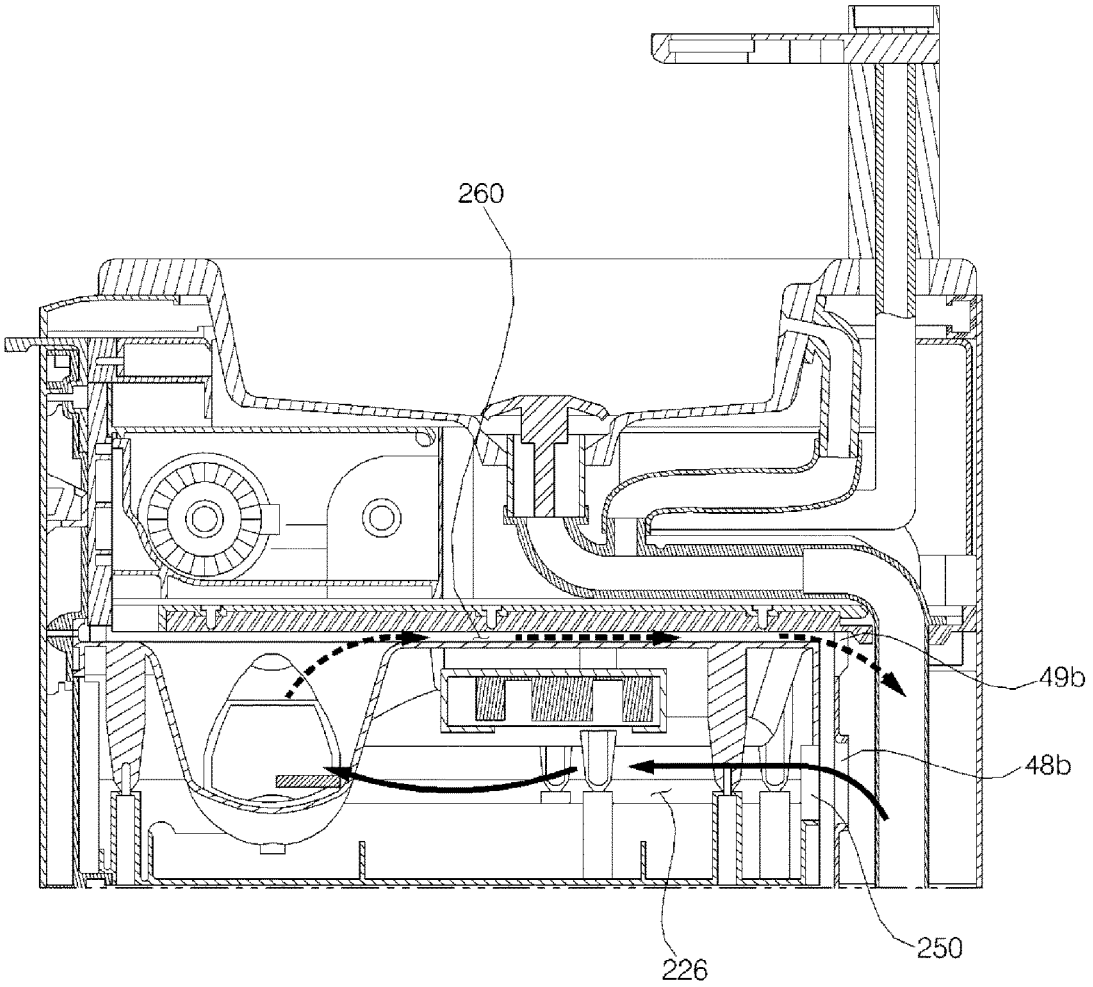
FIG. 19 is a view illustrating air flowing in the inner channel and a discharge channel of the second module according to the embodiment of the present disclosure.
Figure 20:
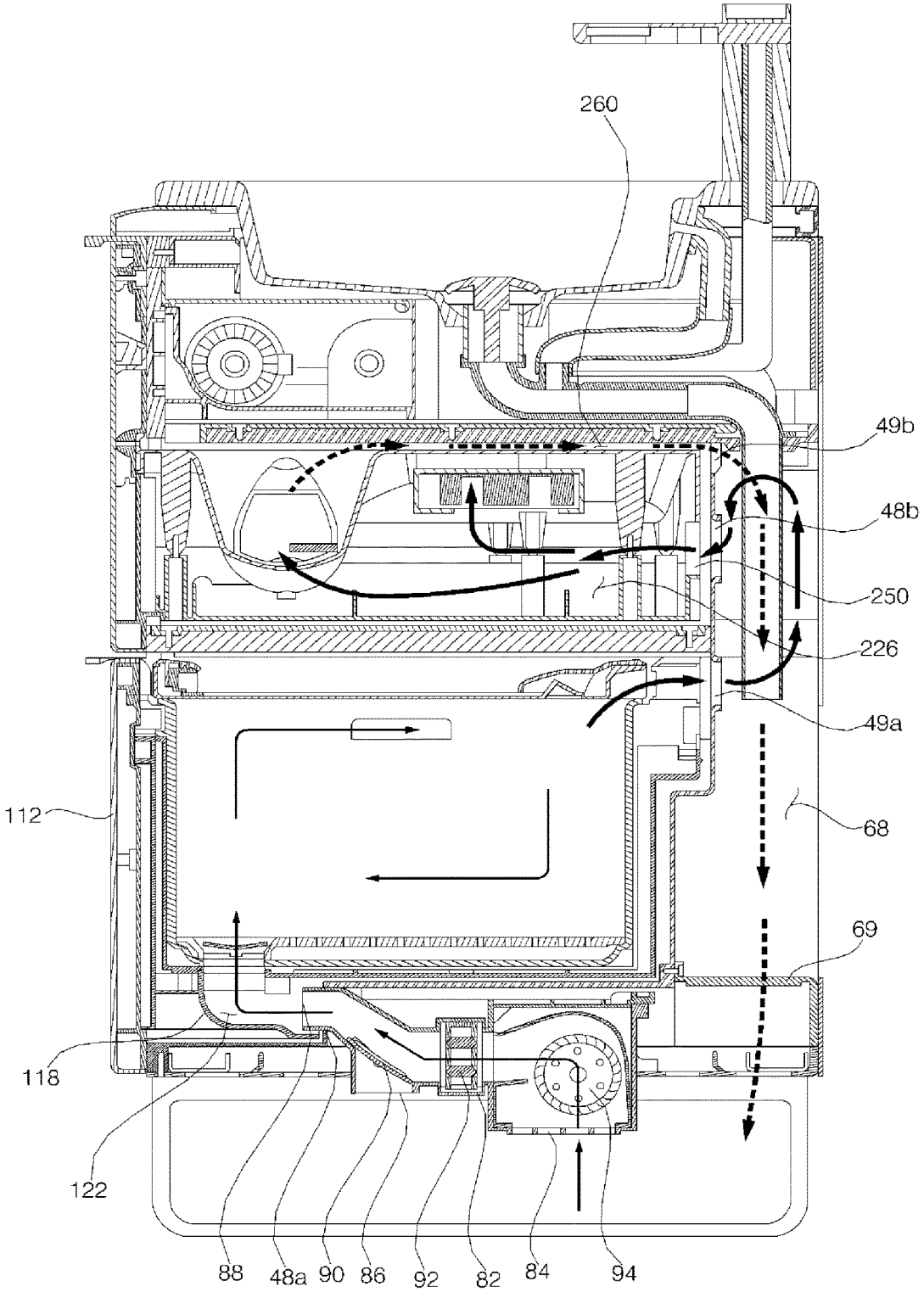
FIG. 20 is a view illustrating the flow of air in the washstand furniture including the first module and the second module according to the embodiment of the present disclosure.

FIG. 15A is a view illustrating the flow of air in the air conditioner in a bottom dehumidification mode. FIG. 15B is a view illustrating the flow of air in the air conditioner in a module-drying mode. FIG. 16 is a view showing the flow of air in the first module due to the operation of the air conditioner in FIG. 15B. FIG. 17 is a view illustrating air flowing to a plurality of fans and suction ports disposed between an upper cover and a lower cover. FIG. 18 is a view illustrating air flowing to a plurality of receiving units in an inner channel of the second module. FIG. 19 is a view illustrating air flowing in the inner channel and a discharge channel of the second module. FIG. 20 is a view illustrating the flow of air in the washstand furniture including the first module and the second module.

Hereinafter, the flow of air in the air conditioner 80, the first module 100, or the second module 200 or the overall flow of air in the washstand furniture including the air conditioner 80, the first module 100, and the second module 200 will be described with reference to FIGS. 15 to 20.

First, the flow of air in the air conditioner 80 and the first module 100 will be described with reference to FIGS. 15 and 16. The air conditioner 80 may operate in a floor dehumidification mode for dehumidifying the floor of the bathroom or a module-drying mode for drying the interior of the module disposed in the cabinet. The vane 90 of the air conditioner 80 is operated to selectively open the first discharge port 86 or the second discharge port 88. The first discharge port 86 and the second discharge port 88 may be selectively opened and closed depending on the operation mode of the air conditioner 80.

In the floor dehumidification mode, the first discharge port 86 in the air conditioner 80 is open, and the second discharge port 88 in the air conditioner 80 is closed. In the floor dehumidification mode, the vane 90 may be disposed as shown in FIG. 15A.

In the floor dehumidification mode, the air conditioner 80 discharges air through the first discharge port 86. In the floor dehumidification mode, the heater 92 and the fan 94 are operated such that hot air is discharged to the floor of the bathroom by forced convection to dry the floor of the bathroom.

In the module-drying mode, the second discharge port 88 in the air conditioner 80 is open, and the first discharge port 86 in the air conditioner 80 is closed. In the module-drying mode, the vane 90 may be disposed as shown in FIG. 15B.

In the module-drying mode, the air conditioner 80 discharges air through the second discharge port 88. In the module-drying mode, the heater 92 and the fan 94 are operated such that hot air is discharged into the module to dry the interior of the module.

Referring to FIG. 16, the vane 90 may be disposed such that the second discharge port 88 of the air conditioner 80 is open in the module-drying mode. The air conditioner 80 suctions air through the suction port 84, which is open toward the floor of the bathroom. When the air conditioner 80 suctions air through the suction port 84, the floor of the bathroom around the suction port is dried by convection of air over the floor of the bathroom.

The air conditioner 80 operates the heater 92 and the fan to discharge hot air into the first module 100. The suction channel 122 guides the air discharged from the second discharge port into the first module 100. The hot air introduced into the first module 100 flows in the first module 100 to dry the utensils held in the first module 100. The hot air flowing in the first module 100 flows upward in the first module 100. The air that has flowed upward in the first module 100 moves to the discharge port 124 above the first module drawer 110. The discharge port connection channel 137, which is formed at one side of the door 130, guides the air that has flowed to the upper side of the first module 100 to the discharge member having the discharge port 124 formed therein.

The air that has flowed to the upper side of the first module drawer 110 of the first module 100 moves to the external connection channel 68 through the discharge port 124. The air introduced from the first module 100 into the external connection channel 68 is discharged through the open lower part of the external connection channel 68. Since the lower part of the external connection channel 68 faces the floor of the bathroom, the air discharged to the outside through the external connection channel 68 dries the floor of the bathroom.

Hereinafter, the flow of air in the second module 200 will be described with reference to FIGS. 17 to 19.

When the fans 240, 242, and 244, which are disposed in the second module drawer 210, are operated, external air is introduced into the second module drawer 210. Referring to FIG. 17, external air may be introduced into the internal channel 226 of the second module drawer 210 through the suction port 250 of the second module suction member 252, which may be disposed at the rear of the second module drawer 210.

Referring to FIG. 18, the air introduced into the internal channel 226 through the suction port 250 flows to the reception units 230, 232, and 234 due to the fans, which are disposed in the internal channel 226. The internal channel 226 communicates with the reception units 230, 232, and 234 via the holes 246, 247, and 248 formed in the upper cover 222. The fans 240, 242, and 244, which move air to the respective reception units 230, 232, and 234, are disposed in the internal channel 226. As the result of moving the air, the residual water suction device 300 disposed in the second module 200 is dried.

Referring to FIG. 19, the air in the internal channel 226 flows to the discharge channel 260 via the reception units 230, 232, and 234. The discharge channel 260 may be defined between the upper cover 222 of the second module 200 and the upper surface 42 of the inner cabinet 40. The air flowing in the discharge channel 260 flows to the external connection channel 68 via the communication hole 49*b* formed in the rear surface 44 of the inner cabinet 40.

Hereinafter, the overall flow of air in the washstand furniture 10 including the first module 100 and the second module 200 will be described with reference to FIG. 20.

In the washstand furniture 10, the air that has been heated by the heater 92 of the air conditioner and has been used in the first module 100 passes through the second module 200. The density of the air discharged from the first module to the external connection channel 68 may be low, since the air has been heated. As a result, the air moves upward in the external connection channel 68. The air that has moved upward in the external connection channel 68 flows in the second module due to the operation of the fans 240, 242, and 244 in the second module 200, which is disposed above the first module 100.

The air that has flowed in the second module 200 moves again to the external connection channel 68, and is discharged through the open lower part of the external connection channel 68. Since the lower part of the external connection channel 68 faces the floor of the bathroom, the air discharged to the outside through the external connection channel 68 dries the floor of the bathroom.

As is apparent from the above description, the washstand furniture according to the present disclosure has the following effects.

First, the interior of the first module is dried using the hot air discharged from the air conditioner, and then the interior of the second module is dried using the air discharged from the first module, whereby waste heat is utilized.

Second, the second module is disposed above the first module, whereby the air discharged from the first module is supplied to the second module without using an additional device.

Third, air is suctioned into the washstand furniture through the suction port in the air conditioner, which is open toward the floor of the bathroom, and air is discharged out of the washstand furniture through the external connection channel, which is open toward the floor of the bathroom. Consequently, the floor of the bathroom is dried by the active flow of air, whereby it is possible to make the bathroom comfortable. Also, in this case, hot air is discharged from the second module, whereby waste heat is utilized.

It is an object of the present disclosure to provide washstand furniture that is capable of utilizing hot air that has been used to dry the interior of a module.

It is another object of the present disclosure to provide washstand furniture configured such that a module is disposed in consideration of the flow of air.

It is a further object of the present disclosure to provide washstand furniture that is capable of making a bathroom comfortable using the flow of air and waste heat.

The objects of the present disclosure are not limited to the above-mentioned objects, and other objects that have not been mentioned above will become evident to those skilled in the art from the following description.

In accordance with the present disclosure, the above and other objects can be accomplished by the provision of washstand furniture which may include: a wash device including a wash bowl, a water supply assembly for supplying water to the wash bowl, and a drainage assembly for draining the water supplied to the wash bowl; an inner cabinet disposed under the wash bowl, the inner cabinet having a space defined therein; an outer cabinet for covering the outside of the inner cabinet; an air conditioner for discharging air heated by a heater disposed therein into the space defined in the cabinet; a first module disposed in the space defined in the inner cabinet, the interior of the first module being dried using the air discharged from the air conditioner; and a second module disposed in the space defined in the inner cabinet, the interior of the second module being dried using air discharged from the first module, wherein an external connection channel for guiding the air discharged from the first module to the second module is defined between the inner cabinet and the outer cabinet, whereby the second module is also dried using heated air that has been used to dry the first module.

The second module may be disposed above the first module, and the external connection channel may be vertically disposed along the first module and the second module, whereby heated air that has been discharged from the first module may be introduced into the second module through the external connection channel.

The first module may include a first module suction member disposed at the lower side thereof, the first module suction member having therein a suction channel for guiding the air discharged from the air conditioner into the first module, and a discharge member having therein a discharge port, through which the interior of the first module and the external connection channel communicate with each other. The discharge member may be disposed at the upper side of the first module. Consequently, air may be introduced through the suction channel, which is disposed at the lower side of the first module, may flow in the first module, and may be discharged through the discharge port, which is disposed at the upper side of the first module.

The second module may include a drawer having therein a plurality of reception units and a plurality of fans for moving air to the respective reception units, whereby the reception units are dried by forced convection.

The outer cabinet may include a side-outer cabinet disposed at opposite side surfaces of the inner cabinet, a rear-outer cabinet disposed at the rear surface of the inner cabinet, and a base-outer cabinet disposed at the lower surface of the inner cabinet. The external connection channel may be defined between the rear-outer cabinet and the rear surface of the inner cabinet so as to be open toward the floor of a bathroom. The air conditioner suctions air through a suction port that is open toward the floor of the bathroom. Consequently, it is possible to dry the floor of the bathroom using heated air that has been used to dry the first module and the second module.

Those skilled in the art will appreciate that the present disclosure may be carried out in specific ways other than those set forth herein without departing from the spirit and essential characteristics of the present disclosure. The above embodiments are therefore to be construed in all aspects as illustrative and not restrictive. The scope of the disclosure should be determined by the appended claims and their legal equivalents, not by the above description, and all changes coming within the meaning and equivalency range of the appended claims are intended to be embraced therein.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present.

As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. Washstand comprising:

a wash device including a wash bowl, a water supply assembly that supplies water to the wash bowl, and a drainage assembly that drains the water supplied to the wash bowl;

an inner cabinet provided under the wash bowl, the inner cabinet having a space;

an outer cabinet that covers an outside of the inner cabinet;

a dryer that discharges air heated by a heater into the space defined in the inner cabinet;

a first module provided in the space defined in the inner cabinet, an interior of the first module being dried using the air discharged from the dryer; and a second module provided in the space defined in the inner cabinet, an interior of the second module being dried using air discharged from the first module, wherein an external connection channel is defined between the inner cabinet and the outer cabinet to guide the air discharged from the first module to the second module.

2. The washstand of claim 1, wherein the second module is provided above the first module.

3. The washstand of claim 2, wherein the external connection channel is provided to extend vertically from the first module toward the second module.

4. The washstand of claim 1, wherein the first module includes a first module suction member provided at a lower side, the first module suction member having therein a suction channel for guiding the air discharged from the dryer into the first module, and a discharge member having therein a discharge port, through which the interior of the first module and the external connection channel communicate with each other.

5. The washstand of claim 4, wherein the discharge member is provided at an upper side of the first module.

6. The washstand of claim 1, wherein the second module includes a second module drawer having a plurality of reception recesses; and a plurality of fans for moving air to the respective reception recesses.

7. The washstand of claim 6, wherein the second module drawer is provided with an internal channel that guides air flowing in the external connection channel to the respective reception recesses.

8. The washstand of claim 6, wherein an upper side of the second module drawer is provided so as to be spaced apart from an upper surface of the inner cabinet to define a discharge channel that guides air discharged into the reception recesses to the external connection channel.

9. The washstand of claim 1, wherein the inner cabinet is provided with a communication hole, through which the interior of the first module or the interior of the second module communicates with the external connection channel.

10. The washstand of claim 1, wherein the outer cabinet includes a side-outer cabinet wall that covers opposite side surfaces of the inner cabinet;

a rear-outer cabinet wall that covers a rear surface of the inner cabinet; and a base-outer cabinet wall that covers a lower surface of the inner cabinet, and wherein the external connection channel is defined between the rear-outer cabinet wall and the rear surface of the inner cabinet so as to be open toward a floor of a bathroom.

11. The washstand of claim 1, wherein the dryer suctions air through a suction port that is open toward a floor of a bathroom.

12. Washstand comprising:

a wash device including a wash bowl, a water supply assembly supplies water to the wash bowl, and a drainage assembly that drains the water supplied to the wash bowl;

an inner cabinet provided under the wash bowl, the inner cabinet having a space;

an outer cabinet that covers an outside of the inner cabinet, an external connection channel in communication with an outside being defined between the outer cabinet and the inner cabinet;

a dryer that discharges air into the space defined in the inner cabinet;

a first module provided in the space defined in the inner cabinet and configured to discharge the air discharged from the dryer to the external connection channel; and a second module provided in the space defined in the inner cabinet, the second module being in communication with the external connection channel.

13. The washstand of claim 12, wherein the outer cabinet includes a side-outer cabinet wall that covers opposite side surfaces of the inner cabinet;

a rear-outer cabinet wall that covers a rear surface of the inner cabinet; and a base-outer cabinet wall that covers a lower surface of the inner cabinet, and wherein the external connection channel is defined between the rear-outer cabinet wall and the rear surface of the inner cabinet so as to be open toward a floor of a bathroom.

14. The washstand of claim 13, wherein the inner cabinet is provided in the rear surface with a communication hole, through which an interior of the second module communicates with the external connection channel.

15. The washstand of claim 13, wherein the dryer is provided between the lower surface of the inner cabinet and the base-outer cabinet wall, the lower surface of the inner cabinet includes an introduction hole for introducing the air discharged from the dryer into the first module, and the rear surface of the inner cabinet includes a discharge hole for discharging air from the first module to the external connection channel.

16. The washstand of claim 13, wherein the first module is provided over the dryer and the second module is provided over the first module.

17. The washstand of claim 13, wherein a connection duct is provided at a bottom of the first module and coupled to an outlet of the dryer, the connection duct being provided at the bottom of the first module to discharge the air into the space at a front side of the cabinet.

18. The washstand of claim 17, wherein first module includes an opening formed at a rear wall toward a top of the first module, wherein the air flowing into the first module through the connection duct is ejected through the opening at the rear wall.

19. The washstand of claim 18, wherein the second module includes a first opening formed at a rear wall of the second module, and a second opening formed at the rear wall of the second module provided over the first opening, wherein at least one fan is configured to draw in air through the first opening and eject the air through the second opening above the first opening.

20. The washstand of claim 19, wherein the external connection channel is provided adjacent to the rear wall of the first module and the rear wall of the second module such that the opening of the first module and the first and second openings of the second module face the external connection channel formed behind the respective rear walls of the first and second modules.

* * * * *